US006386672B1

(12) United States Patent
Kimura et al.

(10) Patent No.: US 6,386,672 B1
(45) Date of Patent: May 14, 2002

(54) INK JET TYPE RECORDING HEAD

(75) Inventors: Hitotoshi Kimura; Ryoichi Tanaka; Tomoaki Takahashi; Tsuyoshi Kitahara; Noriaki Okazawa; Kenji Otokita; Hidenori Usuda; Noboru Tamura; Tsutomu Miyamoto; Kaoru Momose, all of Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/251,401

(22) Filed: Feb. 17, 1999

Related U.S. Application Data

(63) Continuation of application No. PCT/JP98/02663, filed on Jun. 17, 1998.

(30) Foreign Application Priority Data

| | | |
|---|---|---|
| Jun. 17, 1997 | (JP) | 9-176450 |
| Aug. 1, 1997 | (JP) | 9-220901 |
| Mar. 26, 1998 | (JP) | 10-098535 |
| Apr. 10, 1998 | (JP) | 10-099013 |
| May 6, 1998 | (JP) | 10-123748 |

(51) Int. Cl.[7] ..... B41J 29/377; B41J 2/045

(52) U.S. Cl. ..... 347/18; 347/68; 347/17

(58) Field of Search ..... 347/68, 18, 65, 347/57, 58, 59, 17, 69, 88, 14, 70, 71, 72; 361/704, 707, 718; 417/423.8; 257/706, 707, 712, 713

(56) References Cited

U.S. PATENT DOCUMENTS

| | | | | |
|---|---|---|---|---|
| 3,798,506 A | * | 3/1974 | English | 361/704 |
| 4,546,410 A | * | 10/1985 | Kaufman | 361/705 |
| 5,066,964 A | * | 11/1991 | Fukada et al. | 347/18 |
| 5,287,001 A | * | 2/1994 | Buchmann et al. | 257/719 |
| 5,472,324 A | * | 12/1995 | Atwater | 417/423.8 |
| 5,508,908 A | * | 4/1996 | Kazama et al. | 363/141 |
| 5,521,619 A | * | 5/1996 | Suzuki et al. | 347/10 |
| 5,622,897 A | * | 4/1997 | Hayes | 347/68 |
| 5,838,341 A | * | 11/1998 | Hiwada | 347/14 |
| 5,880,754 A | * | 3/1999 | Niikura et al. | 347/18 |
| 6,101,092 A | * | 8/2000 | Onishi | 361/705 |

FOREIGN PATENT DOCUMENTS

| | | | |
|---|---|---|---|
| JP | 2-281958 | 11/1990 | B41J/2/175 |
| JP | 3-10846 | 1/1991 | B41J/2/045 |
| JP | 5-104715 | 4/1993 | B41J/2/045 |
| JP | 8-187860 | 7/1996 | B41J/2/05 |
| JP | 8-244231 | 9/1996 | B41J/2/125 |
| JP | 9-76485 | 3/1997 | B41J/2/01 |
| JP | 2633940 | 4/1997 | B41J/2/175 |
| JP | 409323415 A | * 12/1997 | |

OTHER PUBLICATIONS

International Search Report.

* cited by examiner

*Primary Examiner*—John Barlow
*Assistant Examiner*—Blaise Mouttet
(74) *Attorney, Agent, or Firm*—Sughrue Mion, PLLC

(57) ABSTRACT

An ink jet recording head including a flow path unit having pressure generating chambers, a piezoelectric vibrator for pressurizing the pressure generating chambers, a semiconductor integrated circuit for supplying a drive signal to the piezoelectric vibrator, and a member for absorbing the heat produced by the integrated circuit.

69 Claims, 23 Drawing Sheets

INK JET TYPE RECORDING HEAD

This is a continuation of Application No. PCT/JP98/02663, filed Jun. 17, 1998, the disclosure of which is incorporated herein by reference.

BACKGROUND OF THE INVENTION

1. Field of the Invention

The present invention relates in general to an ink jet type recording head having a case in which (1) a flow path unit forming pressure generating chambers communicating with nozzle openings, (2) a pressure means for pressurizing the pressure generating chambers and (3) a semiconductor integrated circuit for supplying a drive signal to the pressure means are installed, and more particularly to a protective technology for the semiconductor integrated circuit.

2. Description of Related Art

When a length vibration mode of a piezoelectric vibrator, which is described in Patent Laid Open Hei. 5-104715, is used for driving an ink jet type recording head, a contact area where the piezoelectric vibrator contacts a diaphragm is made extremely small, which performs a resolution such as more than 180 dots per inch in each unit.

The length mode of a piezoelectric vibrator is bonded to a fixed base at a predetermined interval and installed in a vibrator unit, and a drive signal/signals is/are independently supplied to each vibrator via a flexible cable from an external drive circuit.

However, in the case of a recording head for a high density printing, in which a pressurizing means such as a piezoelectric vibrator is fixed from 70 $\mu$m to 150 $\mu$m (180–360 dpi), the width of the conductive pattern is inevitably narrow such as from 20 $\mu$m to 50 $\mu$m. Therefore, electrical resistance is increased substantially when many conductive patterns are formed in a limited width of the flexible cable.

In order to solve such problems, a flexible cable A shown in FIG. 24 is divided into area B for transferring the drive signal to an piezoelectric vibrator and area C for transferring a print signal from an external drive circuit to the integrated semiconductor. A window D is formed at boundaries therebetween where a semiconductor integrated circuit E is supplied to convert the print signal into the drive signal, which drives each pressurizing means. The print signal is transmitted to the semiconductor integrated circuit E from the external drive circuit through conductive patterns F, whose number is less than that of the pressurizing means. The drive signal is supplied to each pressurizing means through conductive patterns G, whose number is the same as that of the pressurizing means. Therefore, the number of the conductive patterns F is fewer than the number of conductive patterns G, and the conductive patterns F have a relatively long length. As a result, electric resistance is decreased by expanding the conductive patterns F. The numeral H designates a ground connection.

However, when drive frequency is increased because of a high-speed printing, temperature of the semiconductor integrated circuit is increased, which makes the circuit uncontrolled.

SUMMARY OF THE INVENTION

The present invention relates to an ink jet type recording head having a case, in which (1) a flow path unit forming pressure generating chambers communicating with nozzle openings, (2) a pressure means for pressurizing the pressure generating chambers, and (3) a semiconductor integrated circuit for supplying a drive signal to the pressure means are installed, and heat caused by high frequency drive signals in the semiconductor circuit is promptly dissipated to the outside from exposed parts thereof, which prevents the semiconductor integrated circuit from being uncontrolled by the heat.

Therefore, an object of the present invention is to provide an ink jet recording head, which prevents the semiconductor integrated circuit installed in the recording head with the pressurizing means from being uncontrolled.

DETAILED DESCRIPTION OF THE PREFERRED EMBODIMENT

Figure 1:
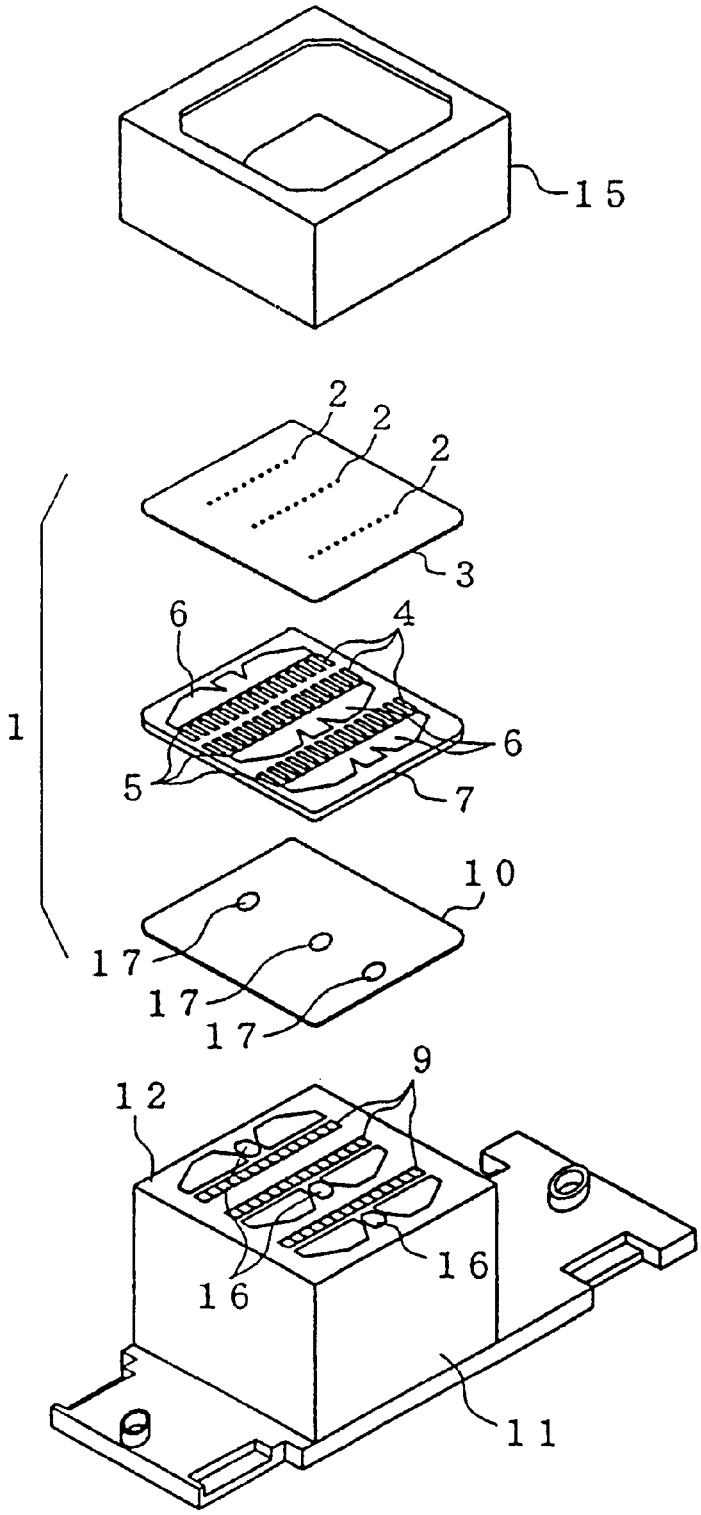
FIG. 1 is a structural perspective view showing one embodiment of an ink jet recording head according to the present invention.

Details of the invention will now be described with reference to embodiments shown in the drawings.

Figure 2:
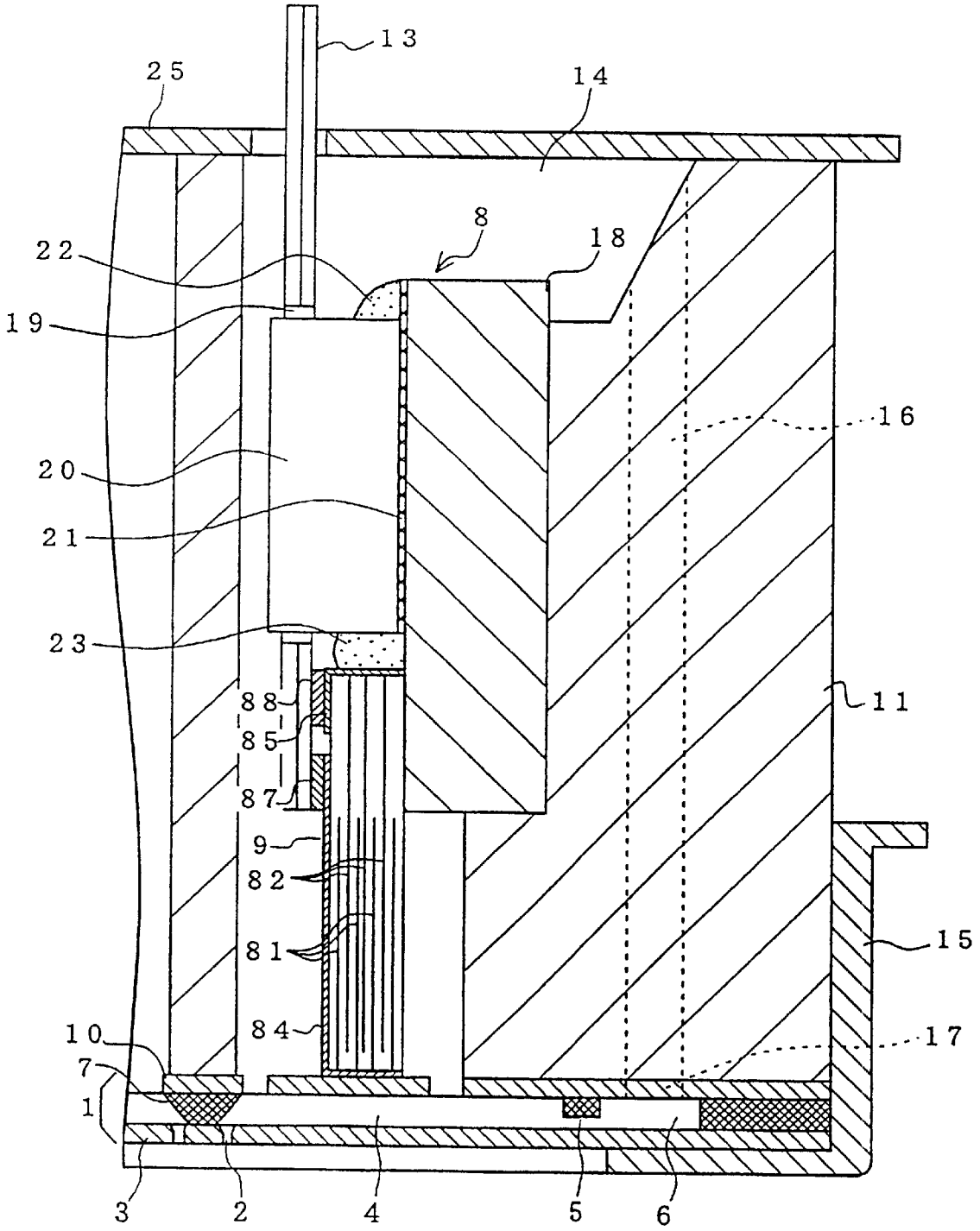
FIG. 2 is a sectional view showing a structure of an ink jet recording head according to the present invention.

FIG. 1 and FIG. 2 show one embodiment of an ink jet recording head of the present invention. A flow path unit 1 is formed, in which a nozzle plate 3, a flow path forming substrate 7 including pressure generating chambers 4 and an elastic plate 10 are laminated. The nozzle plate has nozzle openings 2, which are arranged at a predetermined interval. The pressure generating chambers 4 are communicated with respective nozzle openings 2. The flow path forming substrate 7 is provided with reservoirs 6 supplying ink via ink supply ports. The elastic plate 10 expands or contracts the volume of the pressure generating chambers 4 by contacting to an edge of a length mode of a piezoelectric vibrator in the piezoelectric vibrator unit 8.

A recording head is composed as follows. The flow path unit 1 is arranged at an opening surface 12 of a holder 11 made of a high polymer material formed by injection molding. The piezoelectric vibrator unit 8 is connected with a flexible cable 13 transmitting a drive signal from the outside and installed in a case 14. Each surface of the flow path unit 1 which contacts a holder 11 is fixed by an adhesive, and a frame 15 playing a role as a shield member is inserted. An ink guide path 16 communicating with an external ink tank is formed in the holder 11, and a leading edge of the path is connected with an ink inlet 17. Therefore, the holder has the function both of a holder and a member providing ink from the outside to the flow path unit 1.

Each piezoelectric vibrator 9 whose mode is length vibration is fixed to a fixed base 18 and installed in the piezoelectric vibrator unit 8, in which electrodes 81 and electrodes 82 are laminated in a sandwich structure. The electrodes 81 are exposed to a side of a vibration plate, and the electrodes 82 are exposed to an opposite side of the vibration plate. Each edge surface is connected with the segmental electrodes 84 and the common electrodes 85, respectively, in which piezoelectric constant d31 is used. The piezoelectric vibrator 9 corresponds to an arranged interval of the pressure generating chamber 4, fixed to the fixed base 18, and attached to a unit 8.

Figure 3:
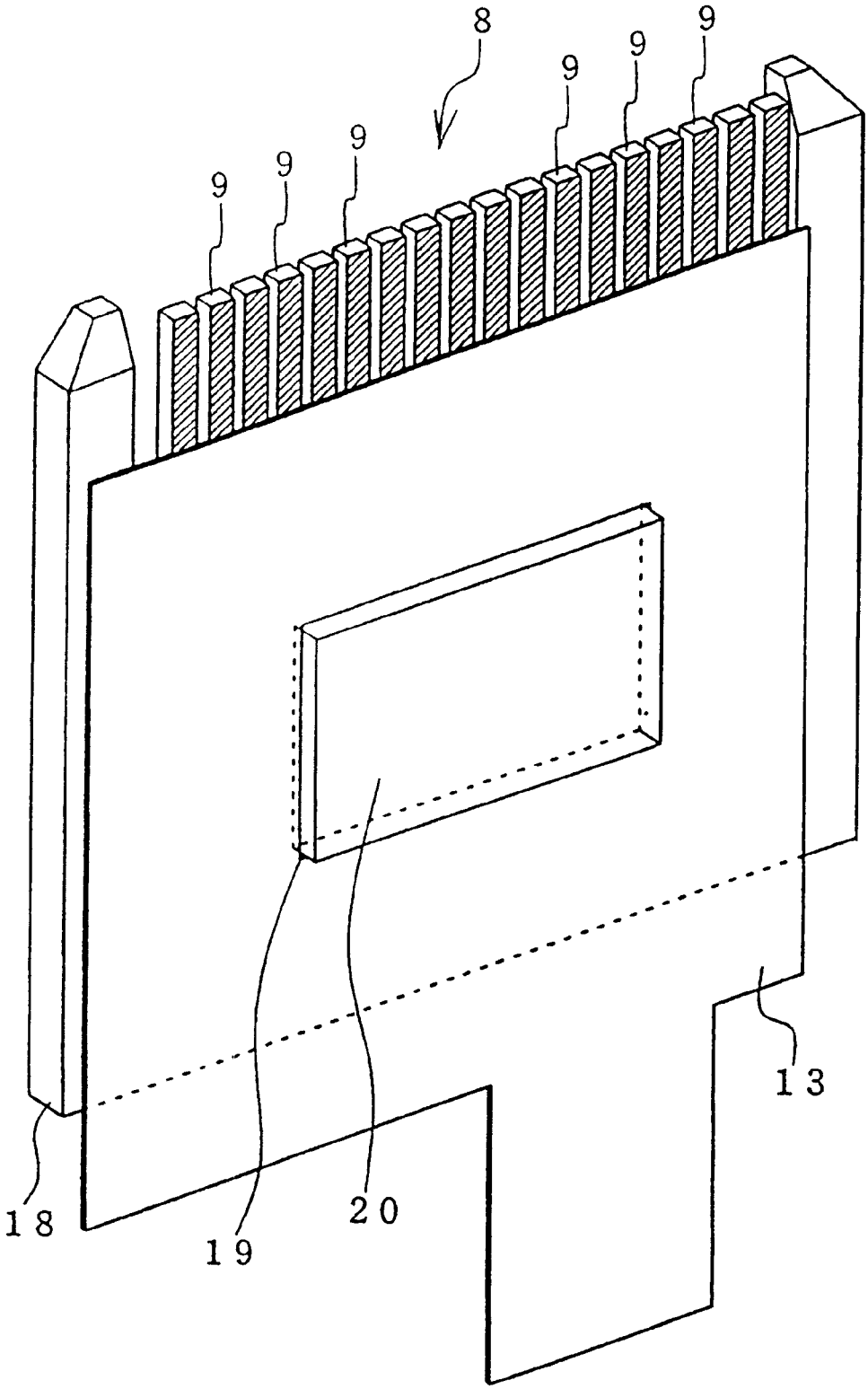
FIG. 3 is a perspective view showing a pressurizing means used for an ink jet recording head according to the present invention.

Each of the segmental electrodes 84 and the common electrode 85 of the piezoelectric vibrator 9 in the piezoelectric vibrator unit 8 are connected with conductive patterns for transmitting a drive signal of the flexible cable 13 via solder layers 87 and 88. A window 19, which faces the fixed base 18, is formed in the flexible cable 13. The window is provided with a semiconductor integrated circuit 20 converting the print signal to the drive signal for driving each piezoelectric vibrator 9 (FIG. 3). The print signal is transmitted from an external drive circuit to the semiconductor integrated circuit 20 by the conductive patterns, whose number is less than that of the piezoelectric vibrators 9. The flexible cable 13 supplies the drive signal from the semiconductor integrated circuit to each piezoelectric vibrator 9 by the conductive patterns, whose number is the same as that of the piezoelectric vibrators 9.

The semiconductor integrated circuit 20 mounted on the flexible cable 13 is fixed to the fixed base 18. An exposed area from the window 19 is fixed by adhesives 22 and 23 or by an adhesive liquid layer 21 having high thermal conductivity such as silicon grease. It is desirable to fabricate the fixed base 18 from thermal conductive materials, such as metal or aluminum.

Figure 4:
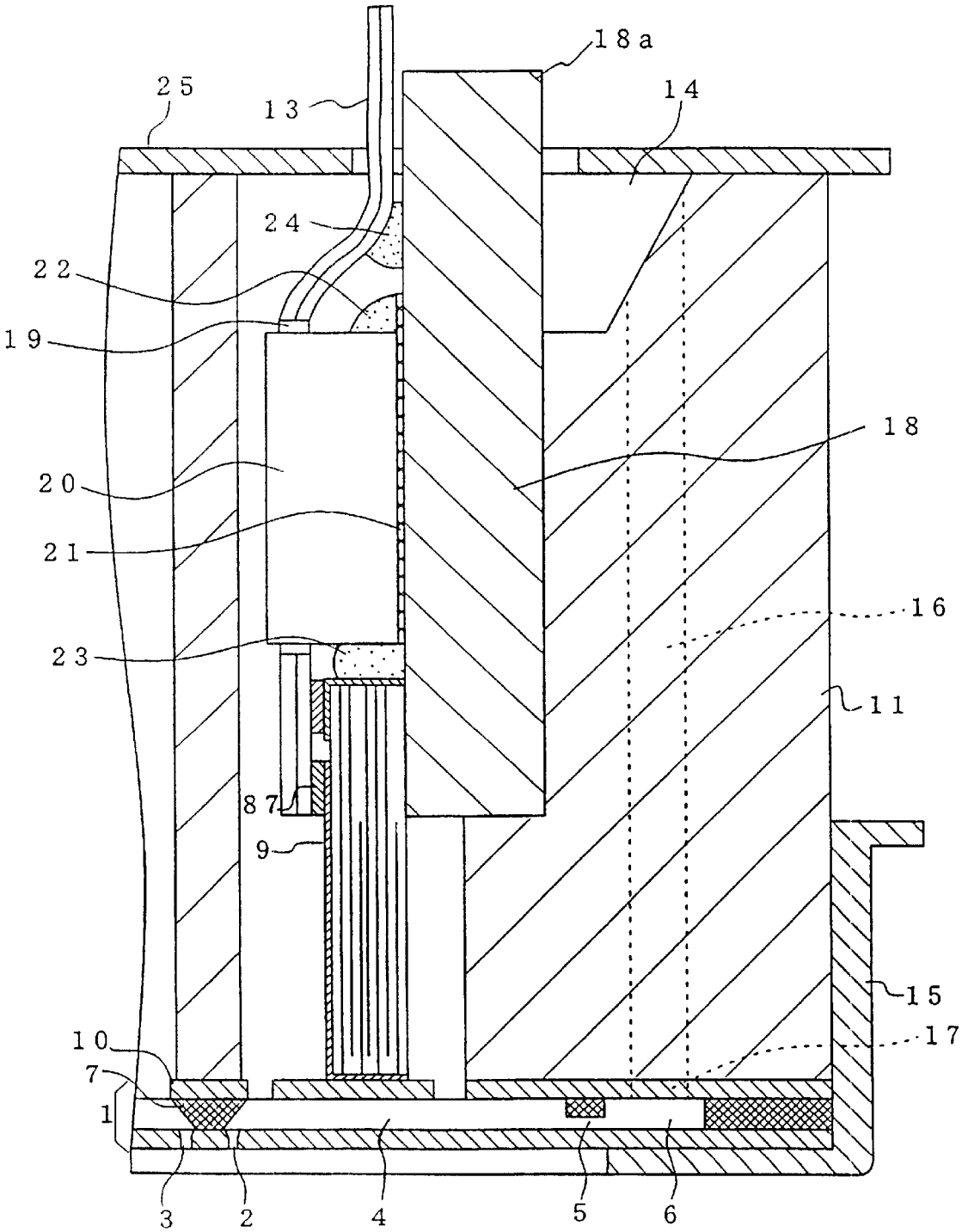
FIG. 4 is a sectional view showing another embodiment according to the present invention.

FIG. 4 is a sectional view showing another embodiment according to the present invention.

According to this embodiment, when the flexible cable 13 is connected with the piezoelectric vibrator unit 8, the semiconductor integrated circuit 20 is fixed to the fixed base 18 by the adhesives 22 and 23 via the heat transfer liquid layer 21. Therefore, even if an external force is unexpectedly applied to the flexible cable 13 in case of inserting a recording head into the head holder 11, the fixed base 18 absorbs the external force via the semiconductor integrated circuit 20 and prevents the piezoelectric vibrators 9 from being damaged and uncontrolled by the force.

When the semiconductor integrated circuit 20 is fixed to the fixed base 18, the flexible cable 13 is drawn to the fixed base 18 and fixed by the adhesive 24 as shown in FIG. 4, so that the piezoelectric vibrators 9 are surely prevented from being damaged by the external force imparted to the flexible cable 13. Moreover, when a rear edge portion 18*a* of the fixed base 18 is exposed to the outside of the holder 11, the cooling effect is significantly increased.

On printing, when the semiconductor integrated circuit 20 receives the print signal via the flexible cable 13 from the external drive circuit, the drive signal for driving the piezoelectric vibrators 9 is generated and supplied to the piezoelectric vibrators 9. The heat generated in the semiconductor integrated circuit 20 is absorbed by the fixed base 18, which has a large heat capacity, and which therefore serves as a heat sink to cool the semiconductor integrated circuit 20. Therefore, the semiconductor integrated circuit 20 is prevented from becoming uncontrolled due to overheating.

Figure 5A:
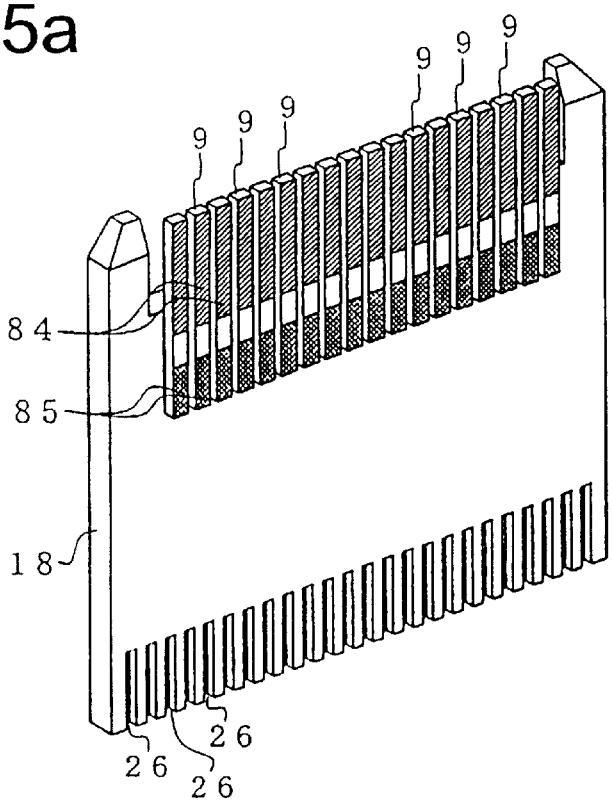
FIGS. 5(*a*) and (*b*) are perspective views showing other embodiments of a piezoelectric vibrator unit of the present invention, respectively.
Figure 5B:
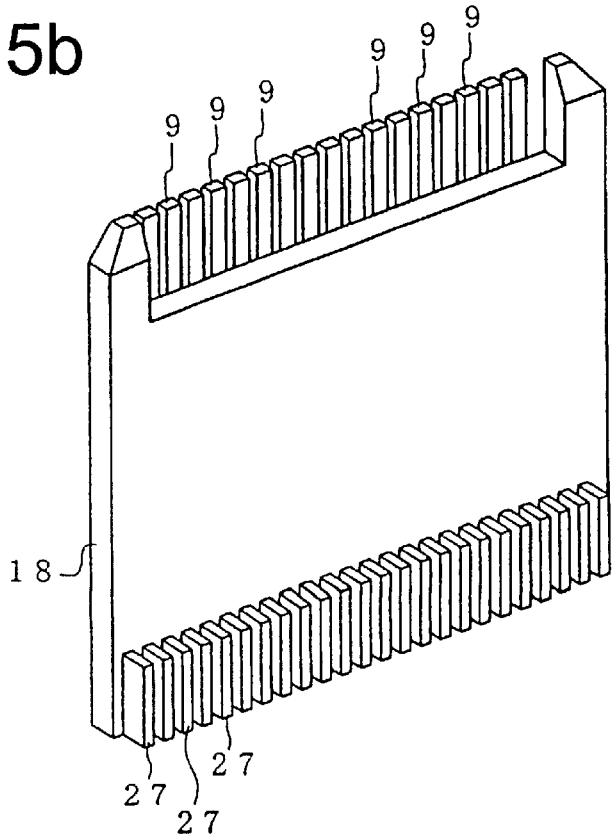

FIGS. 5(*a*) and (*b*) show other embodiments of the present invention, in which concave parts 26 are provided in at least one side surface of a rear edge of the fixed base 18 at a predetermined interval, and fins 27, 27, 27 are provided on a surface of the fixed base 18 that does not face the flexible cable 13, so that a cooling area is expanded, and temperature is promptly prevented from being increased. When the concave parts 26 and the fins 27 are exposed to the outside of the holder 11, the cooling effect is increased substantially.

Figure 6:
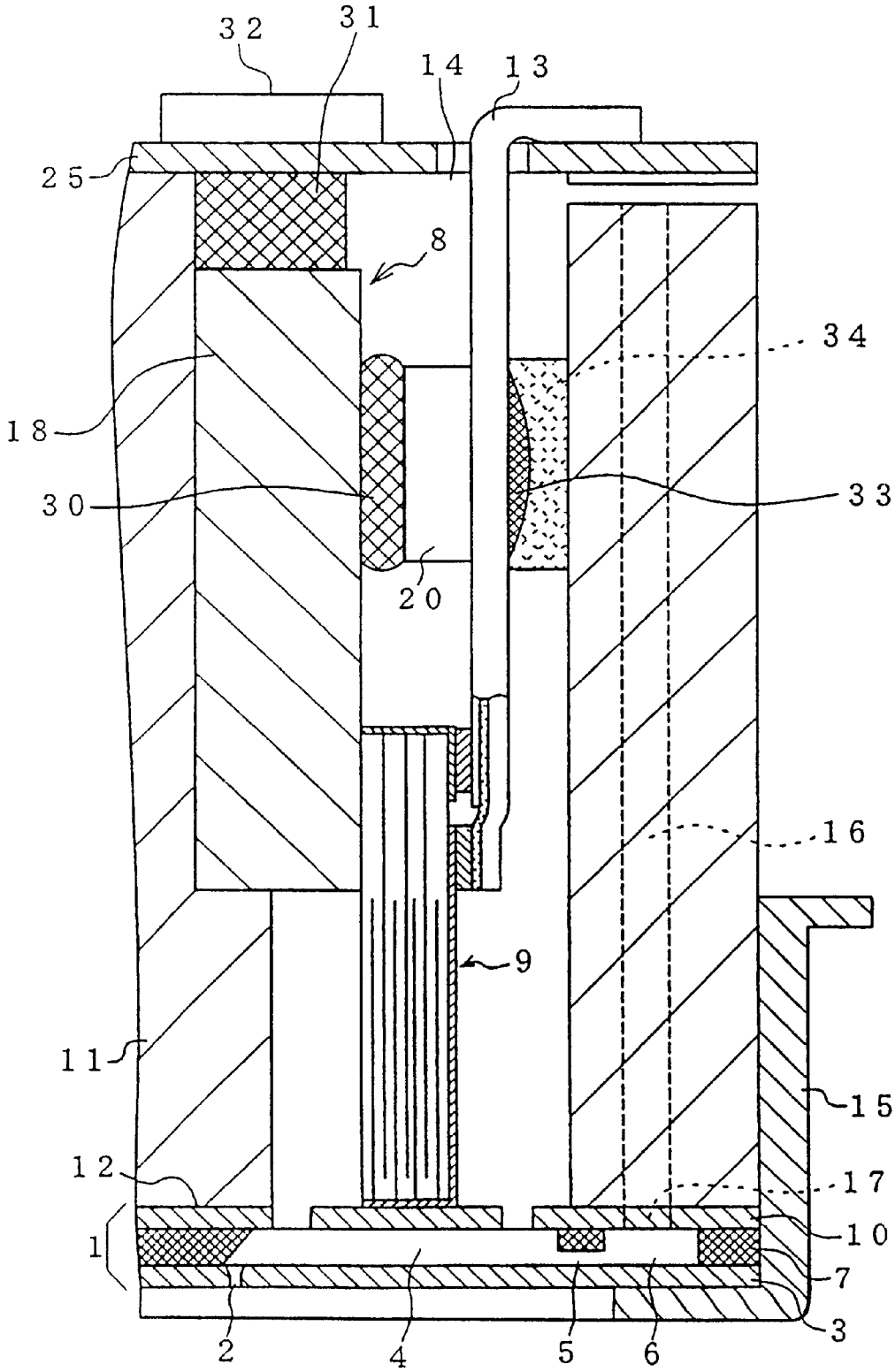
FIG. 6 is a sectional view showing another embodiment of an ink jet recording head according to the present invention.

FIG. 6 shows the semiconductor integrated circuit 20 mounted on the flexible cable 13 at the fixed base side, which is fixed to the fixed base 18 by thermosetting adhesive having high thermal conductivity including aluminum, copper or pulverize alloy thereof.

The fixed base 18 is fixed to a circuit substrate 25, which is provided with an opposite surface where the flow path unit 1 in the holder is fixed, by the thermosetting adhesive having high thermal conductivity including aluminum, copper or pulverize alloy thereof as described above. A cooling fin 32 is provided on the circuit substrate 25, at a position that opposes the thermosetting adhesive 31. Reference numeral 33 in FIG. 6 shows a mold layer formed in a connecting terminal of the semiconductor integrated circuit 20.

In this embodiment, as described above, heat generated in the semiconductor integrated circuit 20 is transmitted to and absorbed in the fixed base 18, which has a large heat capacity, and which therefore serves to cool the semiconductor integrated circuit 20.

When a thermosetting adhesive 34 is filled up between the mold layer 33 and the head case 11, not only is the cooling area expanded, but also the heat is absorbed in the ink flowing in an ink guide path 16 on printing.

Figure 7:
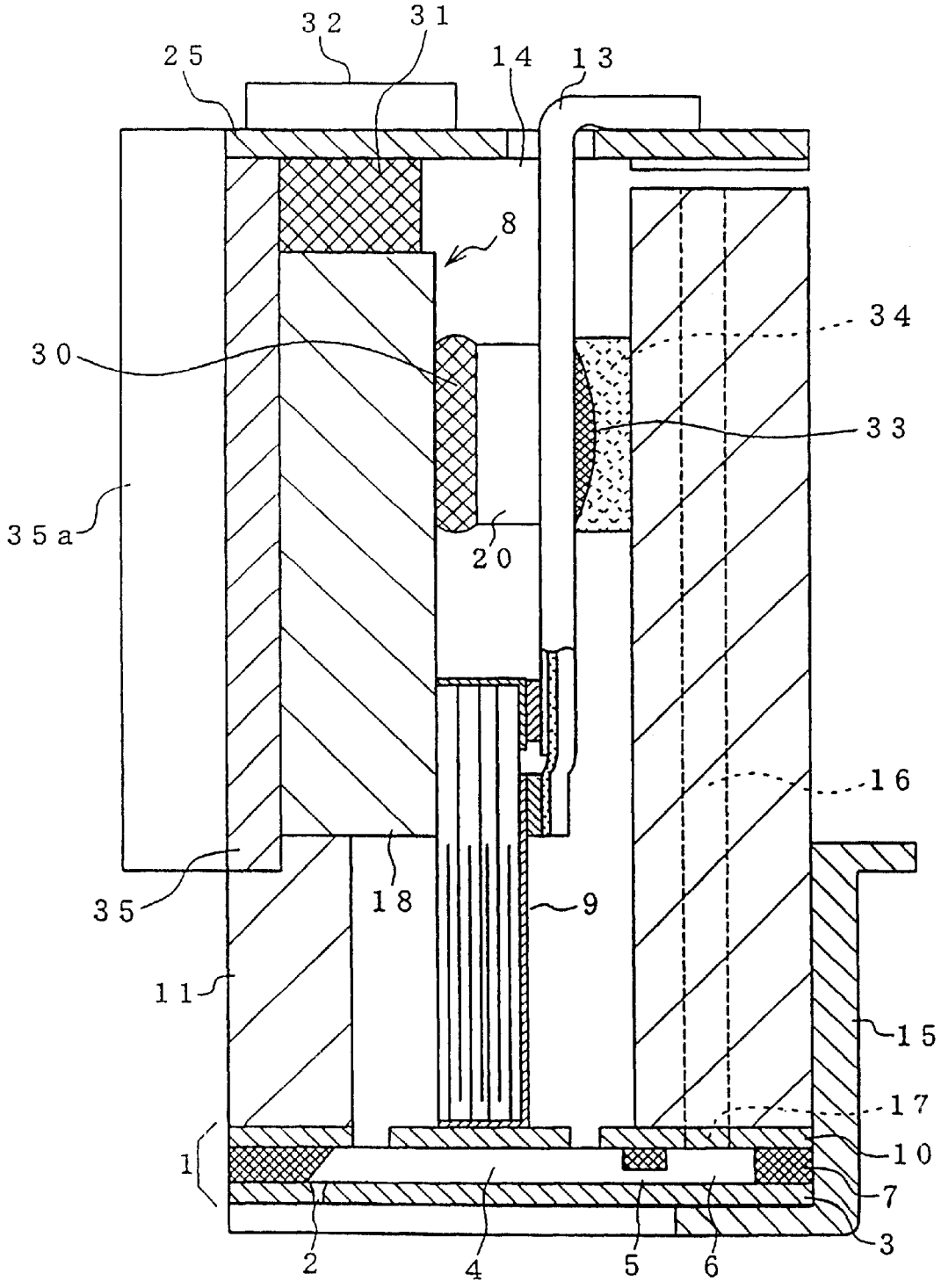
FIG. 7. is a sectional view showing another embodiment of an ink jet recording head according to the present invention.

As shown in FIG. 7, when a cooling plate 35, which is an auxiliary member, is fixed to a backside of the fixed base 18 via thermal insulating rubber or silicon grease having high electrical insulating property and thermal conductivity, the cooling of the semiconductor integrated circuit 20 is facilitated.

Figure 8A:
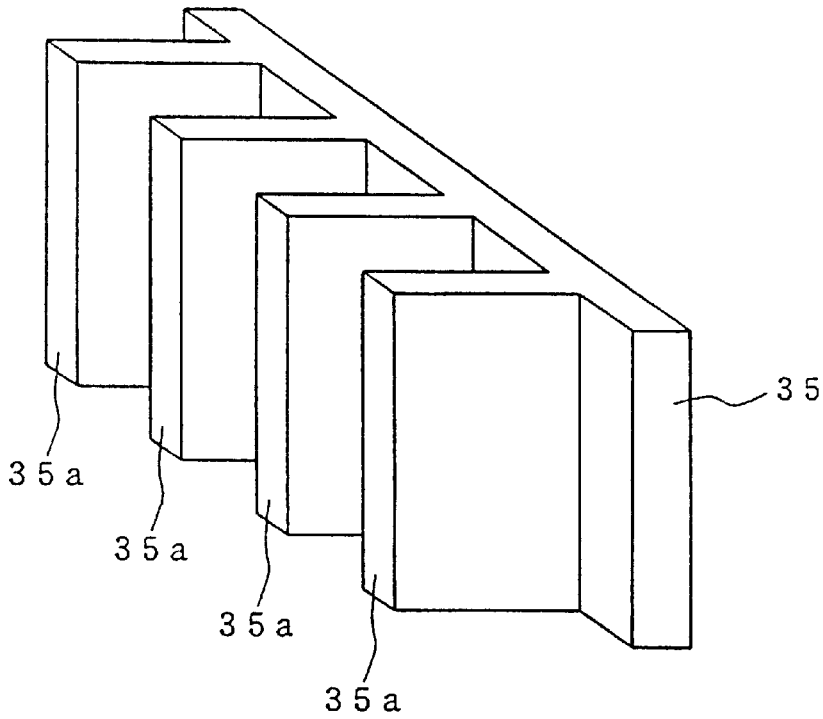
FIGS. 8(*a*) and (*b*) show embodiments of cooling plate used for an ink jet recording head according to the present invention.
Figure 8B:
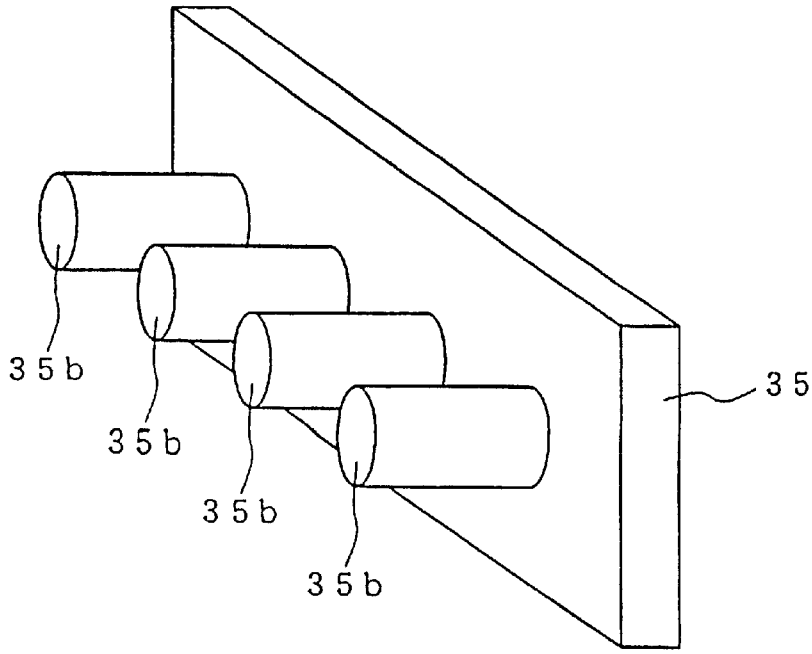

The cooling plate 35, which is composed of aluminum, copper or pulverized alloy is provided with fins 35*a* at an exposed surface as shown in FIG. 8(*a*), or with projections 35*b* as shown in FIG. 8(*b*), respectively at a predetermined interval.

Figure 9:
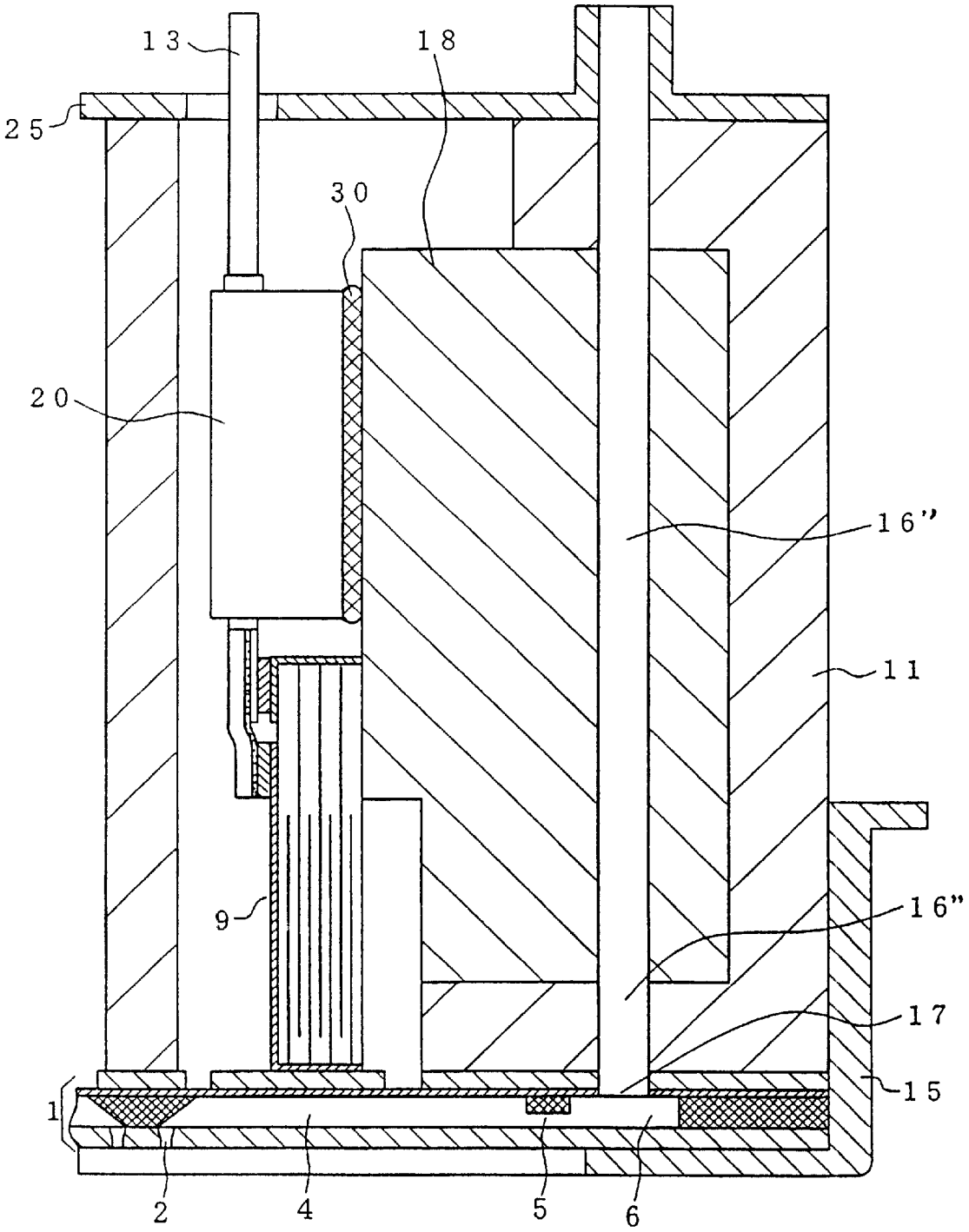
FIG. 9 is a sectional view showing another embodiment of an ink jet recording head according to the present invention.

FIG. 9 shows another embodiment of the present invention, in which the piezoelectric vibrator element 9 is fixed. The fixed base 18, to which the semiconductor integrated circuit 20 is fixed by the thermosetting adhesive 30, is joined with the head holder 11. An ink guide path 16" of the fixed base 18 is connected to the ink guide path 16 of the head holder 11.

According to this embodiment, heat generated in the semiconductor integrated circuit 20 is first absorbed by the thermosetting adhesive 30, and then absorbed by ink flowing in the ink guide paths 16, 16" on printing, so that the heat is surely cooled in combination with the heat sinking function of the fixed base 18.

Figure 10:
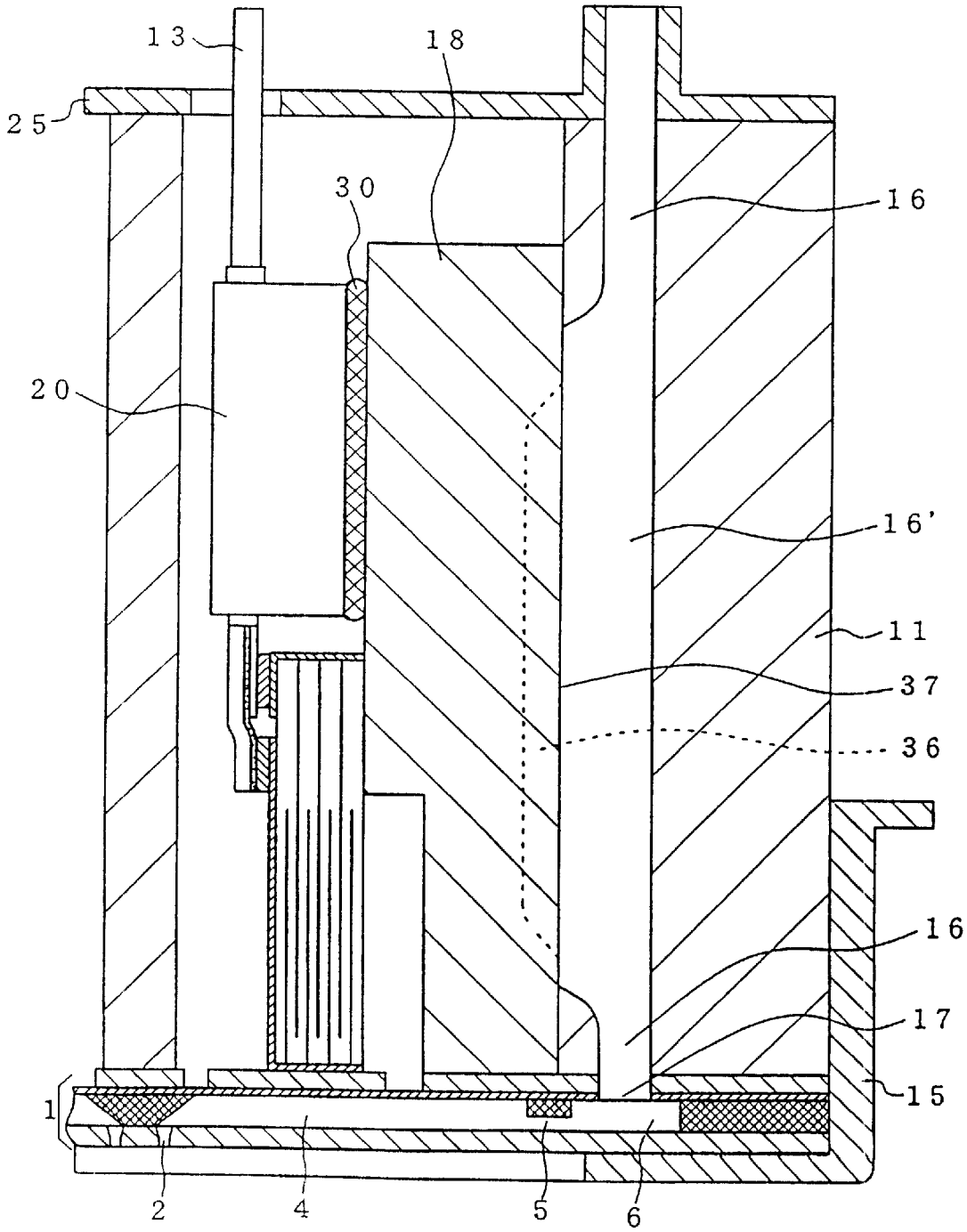
FIG. 10 is a sectional view showing another embodiment of an ink jet recording head according to the present invention.
Figure 11:
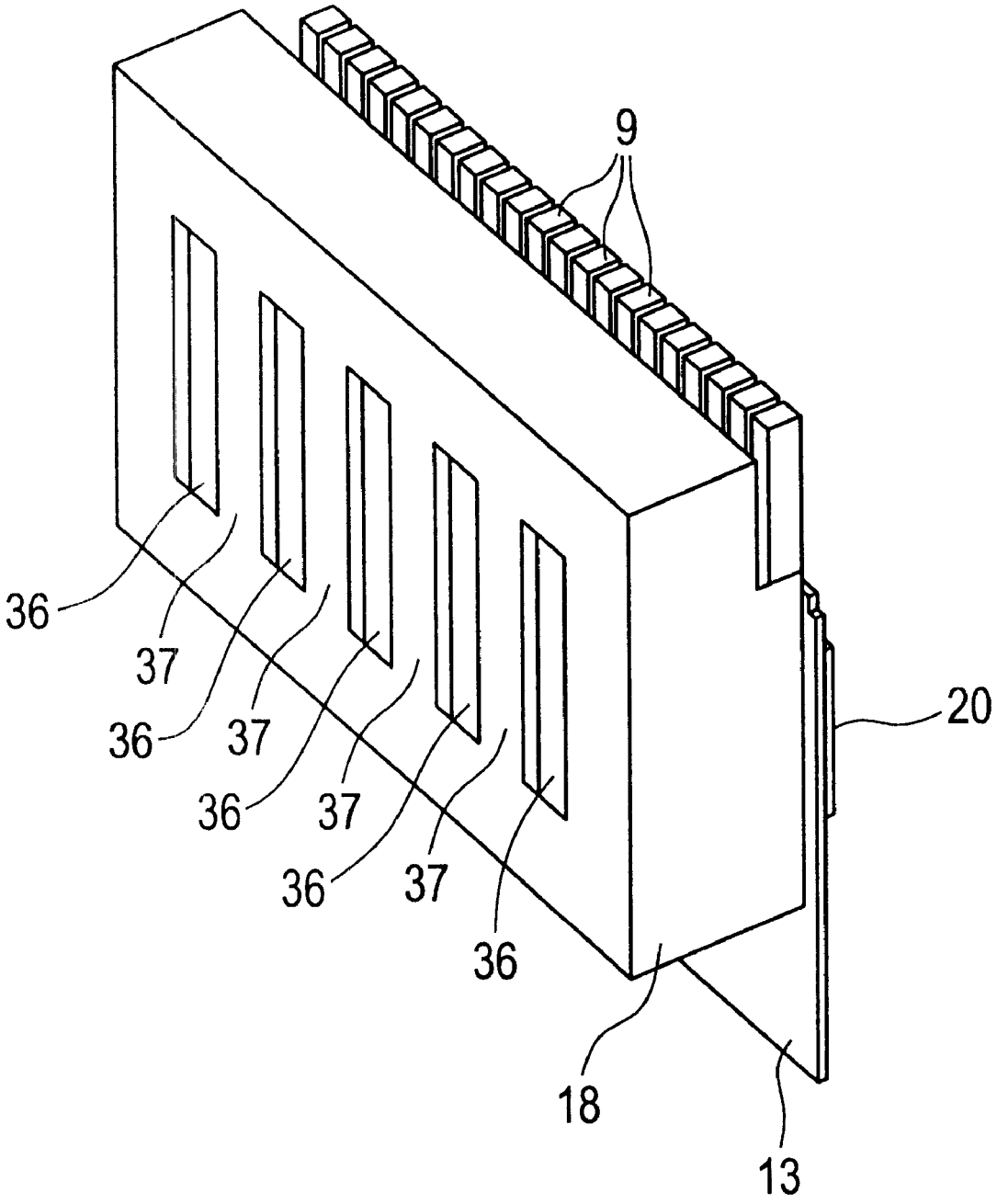
FIG. 11 shows one embodiment of a head holder in an ink jet recording head according to the present invention.
Figure 12:
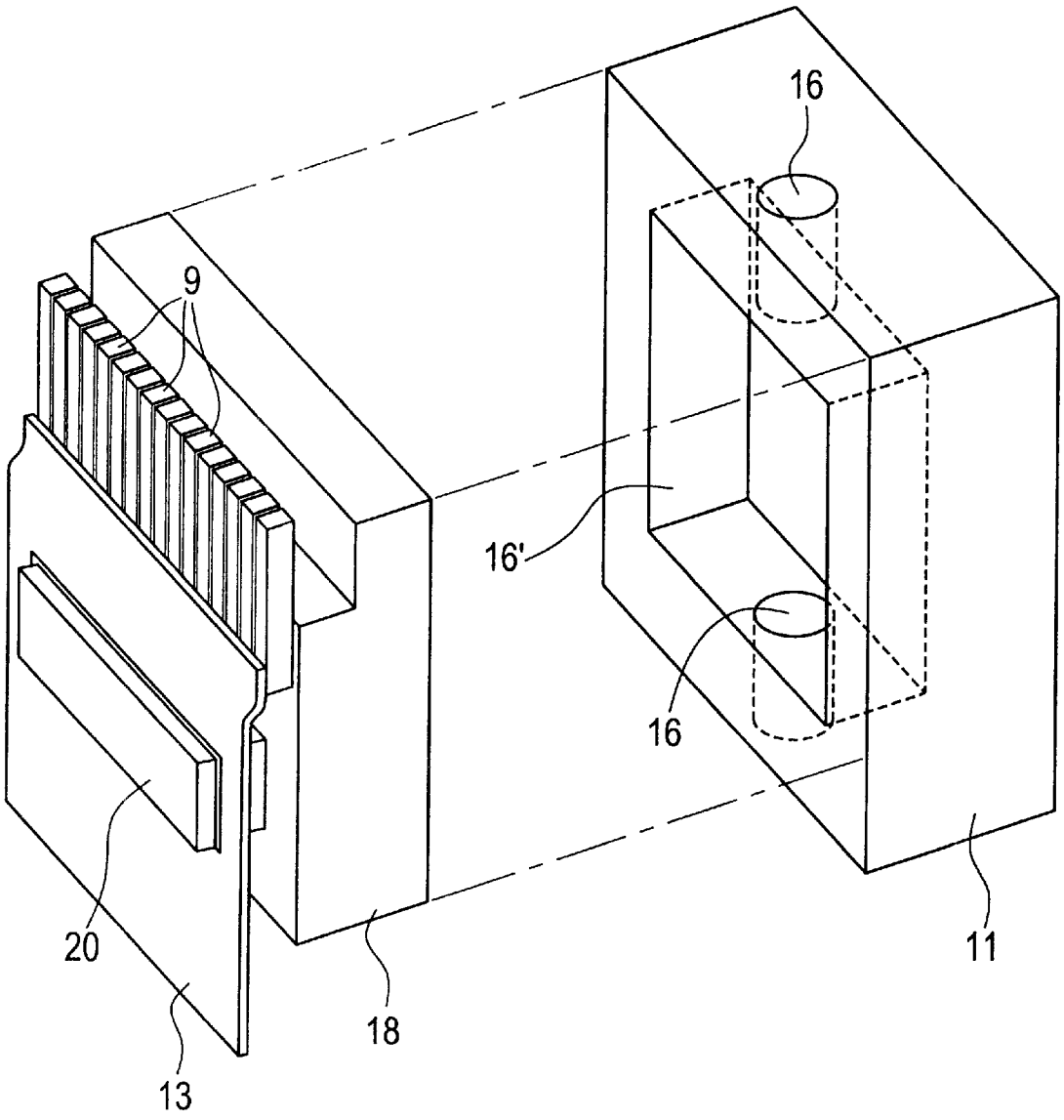
FIG. 12 shows another embodiment of an ink jet recording head of the present invention.

FIG. 10 shows another embodiment of the present invention. In this embodiment, fins 37 are formed on the fixed base 18 at an area which faces the ink guide path 16, and as shown in FIG. 11, concave parts 36 are formed in the fixed base 18 at a predetermined interval. The wide head holder 11 includes a flat concave part 16' communicating with an upper and a lower edge of the ink guide path 16, and having an opening 16'*a* that opens toward the fixed base 18. The opening 16'*a* of the concave part 16' is sealed by the side of the fixed base 18 on which the fins 37 are provided.

According to this embodiment, the fins 37, which are formed in the fixed base 18, provide a large surface area that contacts the ink flowing into the flow path unit 1. Accordingly, the heat from the semiconductor integrated circuit 20, which has been transmitted to the fixed base 18 and absorbed by the ink, is removed from the device during ink ejection.

Figure 13:
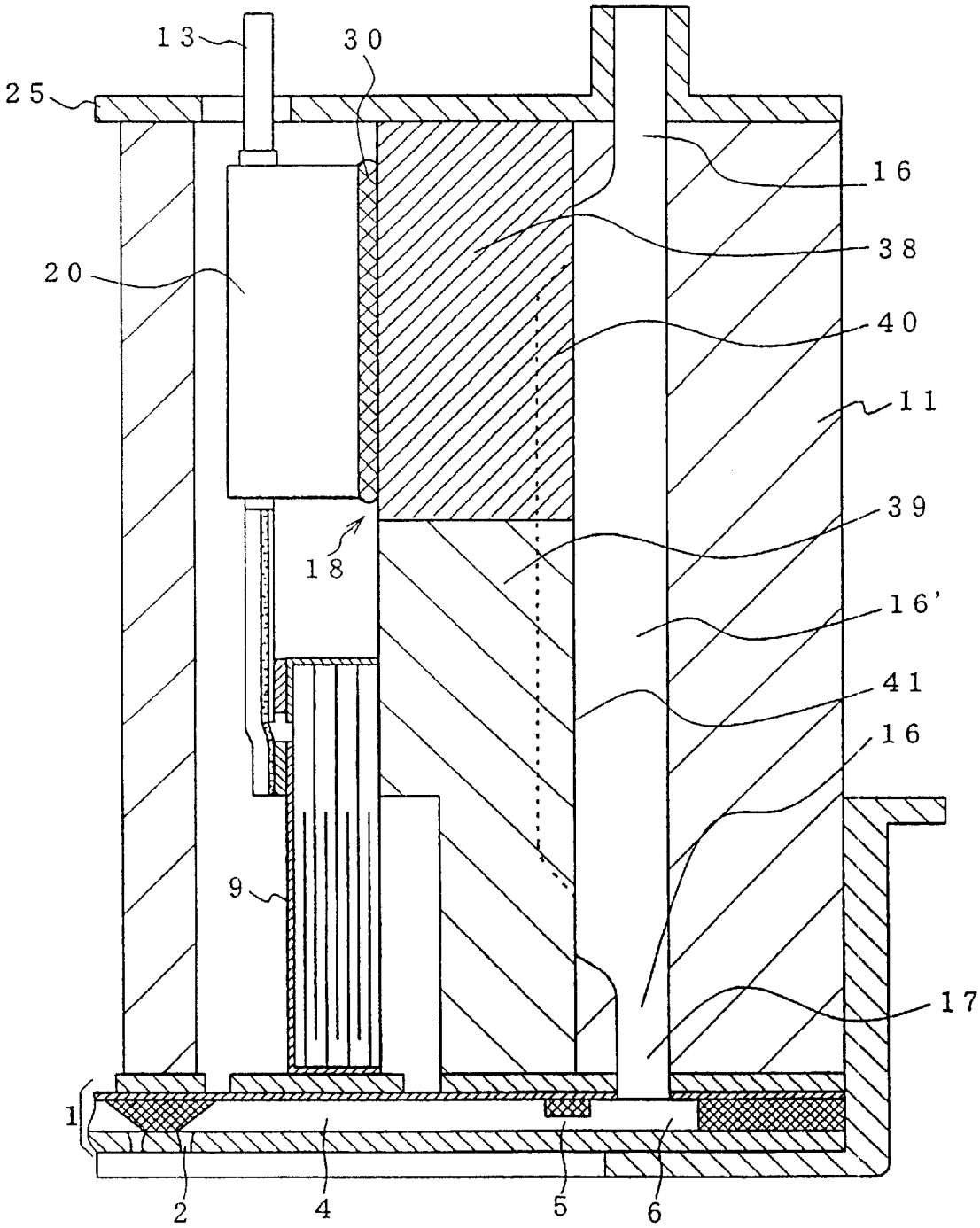
FIG. 13 is a sectional view of another embodiment of an ink jet recording head according to the present invention.

FIG. 13 shows another embodiment of the present invention. The fixed base 18 includes two members comprising a member 39 for fixing the piezoelectric vibrators 9 and a member 38 for fixing the semiconductor integrated circuit 20. The member 38 is composed of material having relatively high thermal conductivity, such as stainless steel. The fixed base 18 is sealed with an adhesive and integrally formed, and a fin 41 is formed as described above, in which a concave part 40 is formed at a predetermined interval. An upper edge of the member 38 contacts the circuit substrate 25.

According to this embodiment, the fixed base 18 and the ink flowing to the flow path unit 1 via the concave part 16' of the ink guide path 16 absorb heat from the semiconductor integrated circuit 20. The heat removed from the semiconductor integrated circuit 20 flows to the ink and the circuit substrate 25, which is exposed to the outside, through the member 38 having excellent heat conductivity.

Figure 14:
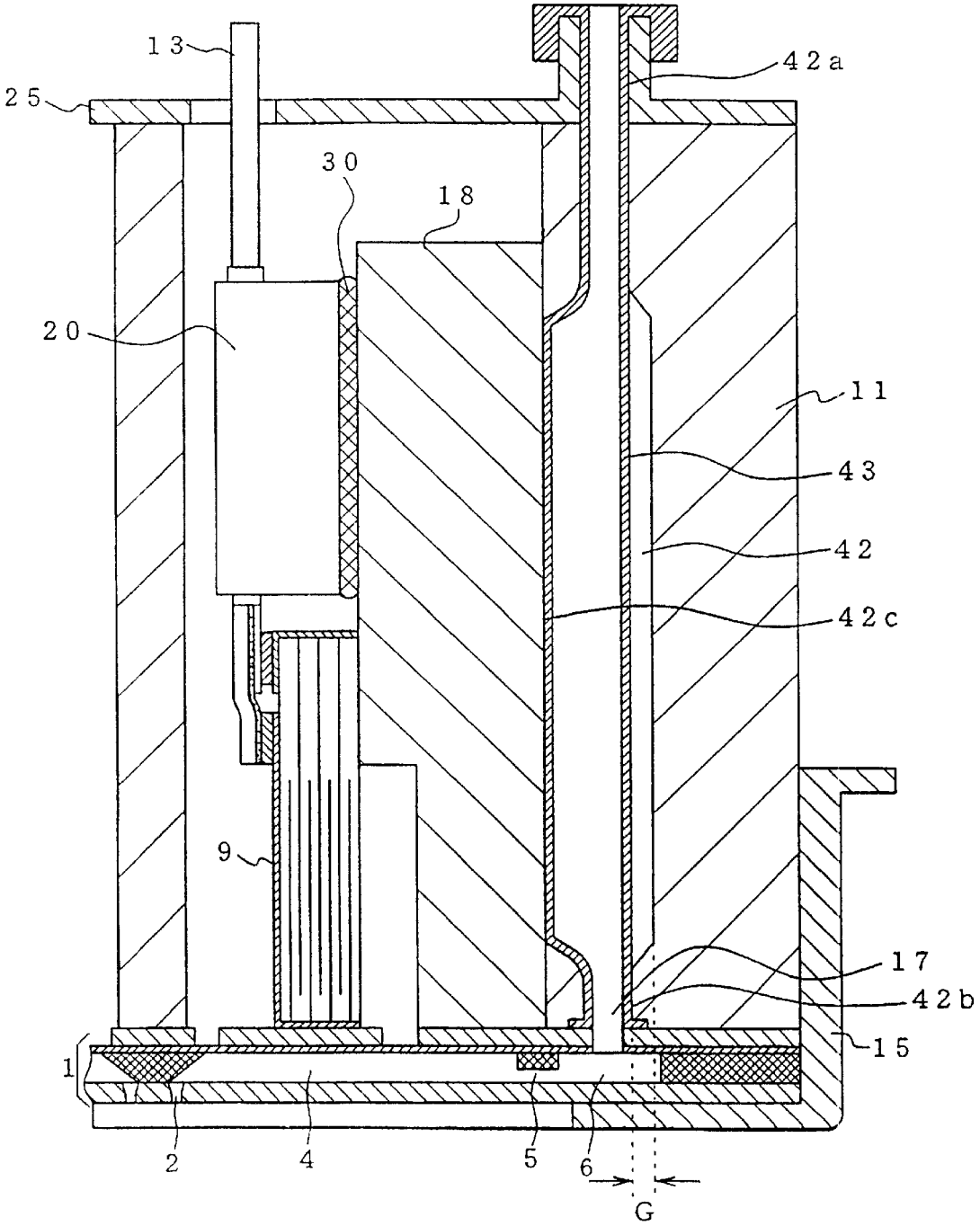
FIG. 14 is a sectional view showing another embodiment of an ink jet recording head according to the present invention.

FIG. 14 shows another embodiment of the present invention, in which the ink guide path in the head holder 11 is provided with communicating holes 42*a* and 42*b*, and a concave part 42 having a window 42*c* which faces the fixed base 18 is formed.

An ink guide forming member 43 extends from an upper edge of the communicating hole 42*a* to an ink inlet 17 of the reservoir 6, contacts the fixed base 18 at the window 42*c* and is composed of liquid-tight film having resiliency, and forms a gap G at the holder 11.

According to this embodiment, the ink flows into the flow path unit 1 via the ink guide forming member 43. During the process, the heat, which is conducted to the fixed base 18 from the semiconductor integrated circuit 20, is absorbed by the ink via the ink guide forming member 43.

When print data is switched back and forth between (1) text data, which consumes relatively less ink, and (2) graphic data, which consumes relatively more ink, the velocity of the ink flowing in the ink guide forming member 43 is rapidly changed, which causes a water hammer phenomena. Pressure fluctuation of the ink caused by the water hammer phenomena, is absorbed by the expansion and contraction of the ink guide forming member 43 to fill up the gap G, and is prevented from being transmitted to the reservoir 6 and the pressure chamber 4.

Figure 15A:
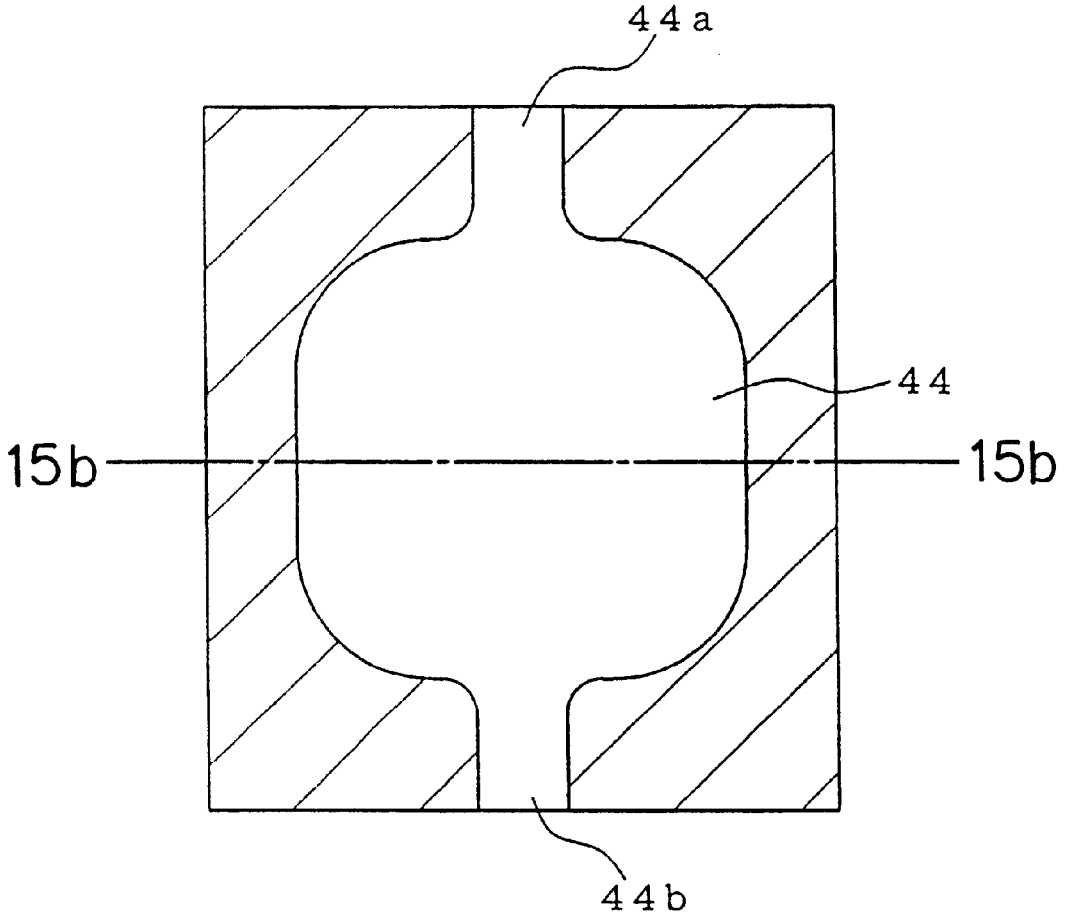
FIG. 15(*a*) is a longitudinal sectional view showing one embodiment of an ink guide path of a head holder, and FIG. 15(*b*) is a sectional view taken B—B line, both of which are suitable for an ink jet recording head according to the present invention.
Figure 15B:
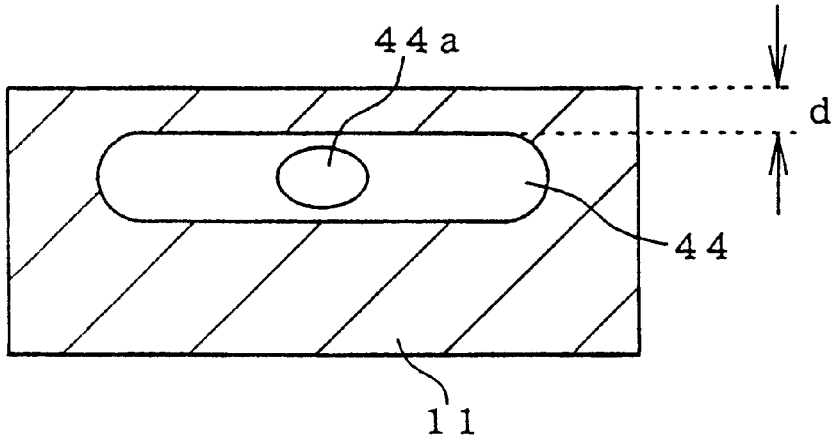

In the above-mentioned embodiment, the heat is conducted to the ink through contact with the fixed base 18. However, as shown in FIG. 15, it is also acceptable that a flat expanded area 44, an ink flow inlet 44*a*, and an ink outlet 44*b* are formed where the fixed base 18 in the head holder contacts the ink guide path in order to enlarge a cross sectional area at the side of the fixed base, and that an ink flow path whose wall thickness d contacting the fixed base 18 is formed as thin as possible to maintain mechanical strength. When boundaries between the ink flow inlet 44*a* and the expanded area 44, between the ink outlet 44*b* and the ink flow inlet 44*a*, are formed to be expanded or contracted to make a smooth curve, bubbles are prevented from remaining.

According to this embodiment, the ink is transmitted to a large area of the fixed base 18 with small heat resistance, so that the heat of the fixed base is quickly conducted and cooled to the ink.

Figure 16:
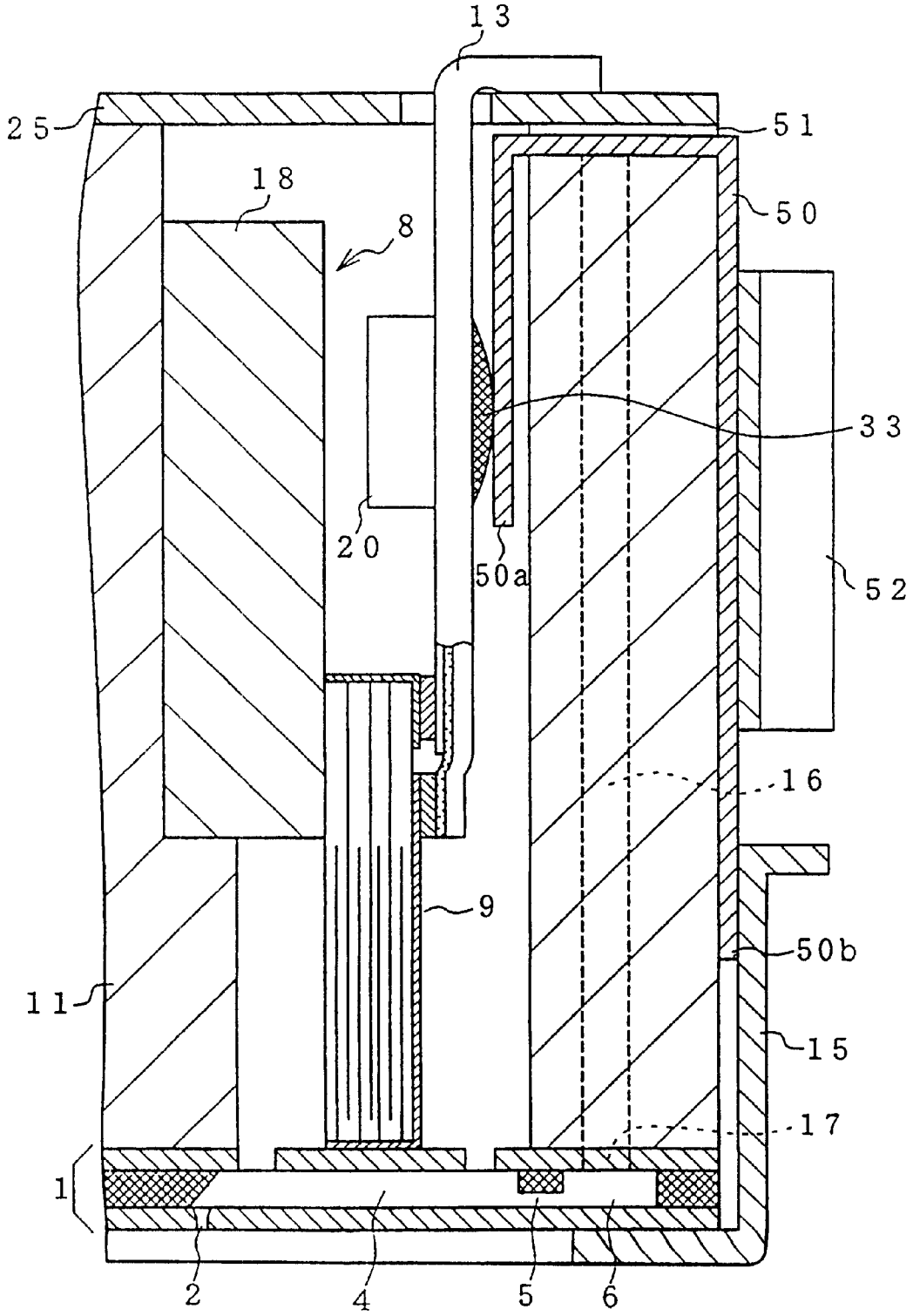
FIG. 16 and FIG. 17 are sectional views showing other embodiments of an ink jet recording head of the present invention.
Figure 17:
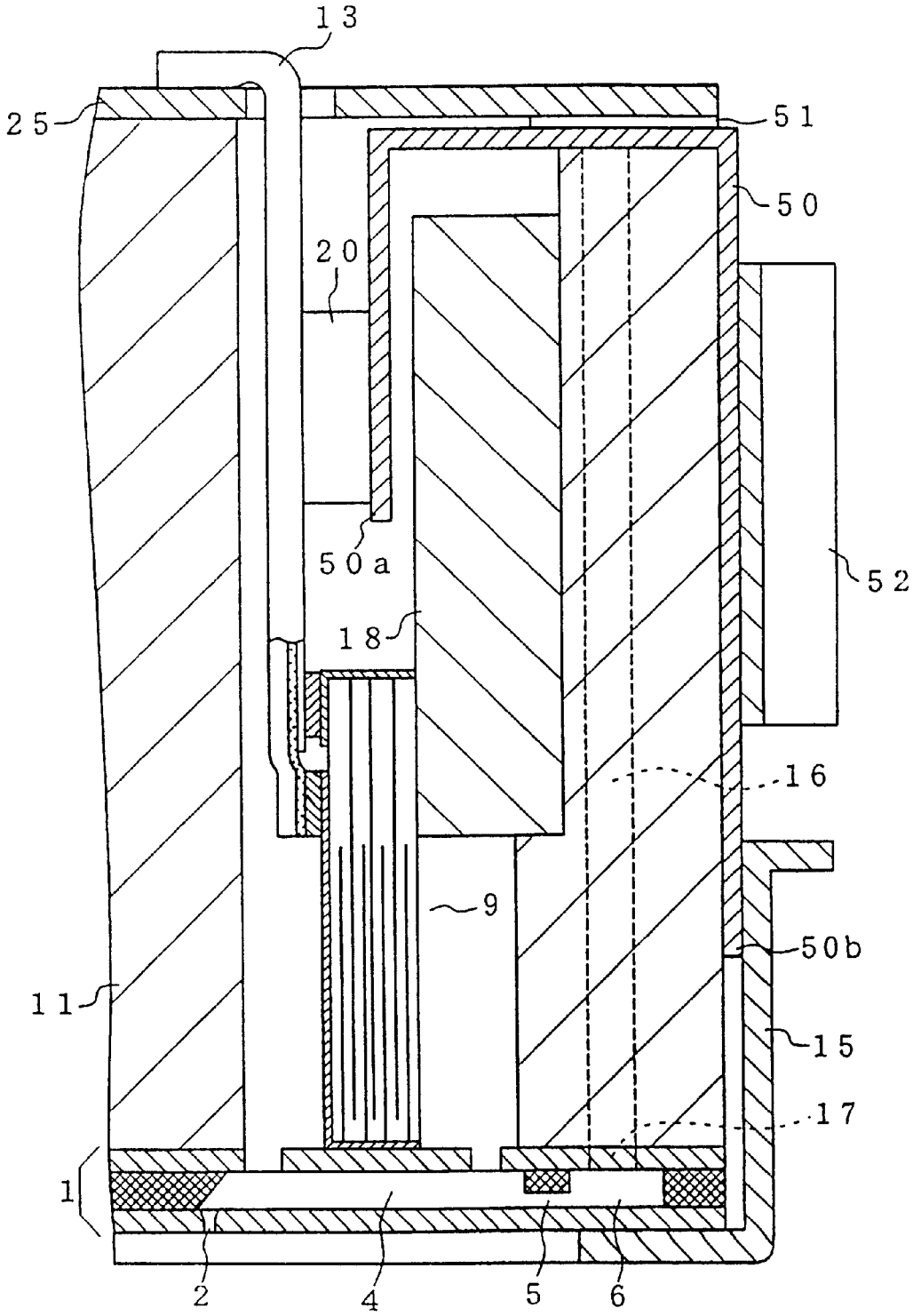

FIG. 16 and FIG. 17 show other embodiments of the present invention. In this embodiment, a heat conductive material 50 in the form of a bent thin plate or foil made of copper or aluminum is disposed to contact an area where the heat is conducted from the semiconductor integrated circuit 20, more specifically a surface of a mold 33 covering a terminal of the semiconductor integrated circuit 20 or a surface of the semiconductor integrated circuit 20 itself as shown in FIG. 17. The heat is conducted from the semiconductor integrated circuit 20 to one end 50*a* of the heat conductive material 50, and the other end 50*b* is extended from a gap 51 formed between the head case 11 and the circuit substrate 25.

The heat conductive, material 50 is adhered to a side of the head case 11, preferably fixed such that the end 50*b* extends to an inside of the frame body 15, and the heat is conducted therebetween. More preferably, a cooling fin 52 is fixed to an area which is exposed to the outside in order to facilitate cooling heat.

Material having an electrical insulating characteristic and high thermal conductivity, such as electrical insulating rubber or silicon grease, is used for the heat conductive material 50, the semiconductor integrated circuit 20, the frame body 15, and the cooling fin 52.

According to this embodiment, when the semiconductor integrated circuit 20 drives the piezoelectric vibrators 9 and generates the heat, the heat is first conducted to the heat conductive material 50 and to the outside of the head case 11, and cooled quickly.

The heat conductive material 50 is adhered to the head case 11, so that ink flowing in the ink guide path 16 disposed in the vicinity of the plate absorbs heat via the head case 11. Therefore, the more a load is increased or the more volume of the ink droplet per unit hour is increased, the more cooling effect is increased, which surely radiates the heat of the semiconductor integrated circuit 20 and assures reliance, even if the load is high.

When the heat conductive material 50 is fixed to the frame body 15, the heat is conducted to and cooled from the frame body 15, too. When the cooling fin 52 is provided, the cooling effect is significantly increased.

When static electricity from the outside affects the heat conductive material 50, the cooling fin 52, and the frame body 15, the electrical insulating rubber or silicon grease, which has electric insulating and thermal conducting properties and connects the plate 50 with the semiconductor integrated circuit 20, the heat conductive material 50 with the cooling fin 52, and the heat conductive material 50 with the frame body 15, prevents the semiconductor integrated circuit 20 from being subject to the static electricity as much as possible and from being uncontrolled.

Figure 18:
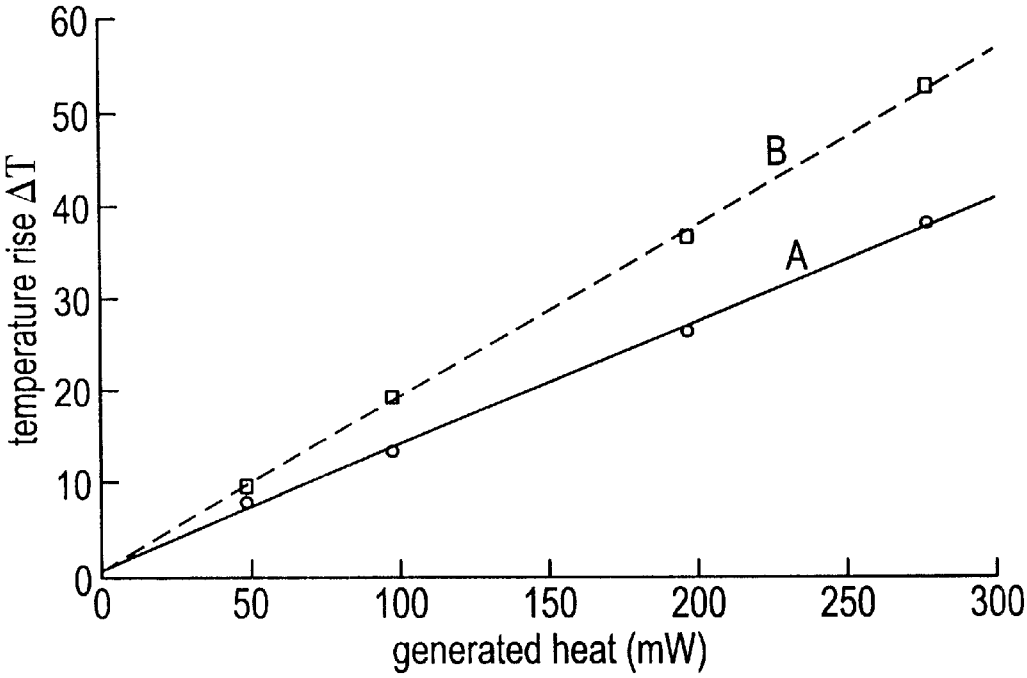
FIG. 18 is a chart showing the relationship between generated heat and temperature rise $\Delta T$ in an ink jet recording head both according to a conventional type and the present invention.

FIG. 18 shows a load both in an ink jet recording head of the present invention and in a recording head having no heat conductive material 50, namely, the relationship between temperature rise $\Delta T$ of the semiconductor integrated circuit 20 versus generated heat. The temperature rise in the recording head having the heat conductive material 50 of the present invention (as shown in a solid line (A)) is approximately 30% lower than that in the recording head having no heat conductive material 50 (as shown in a dotted line (B)).

Figure 19:
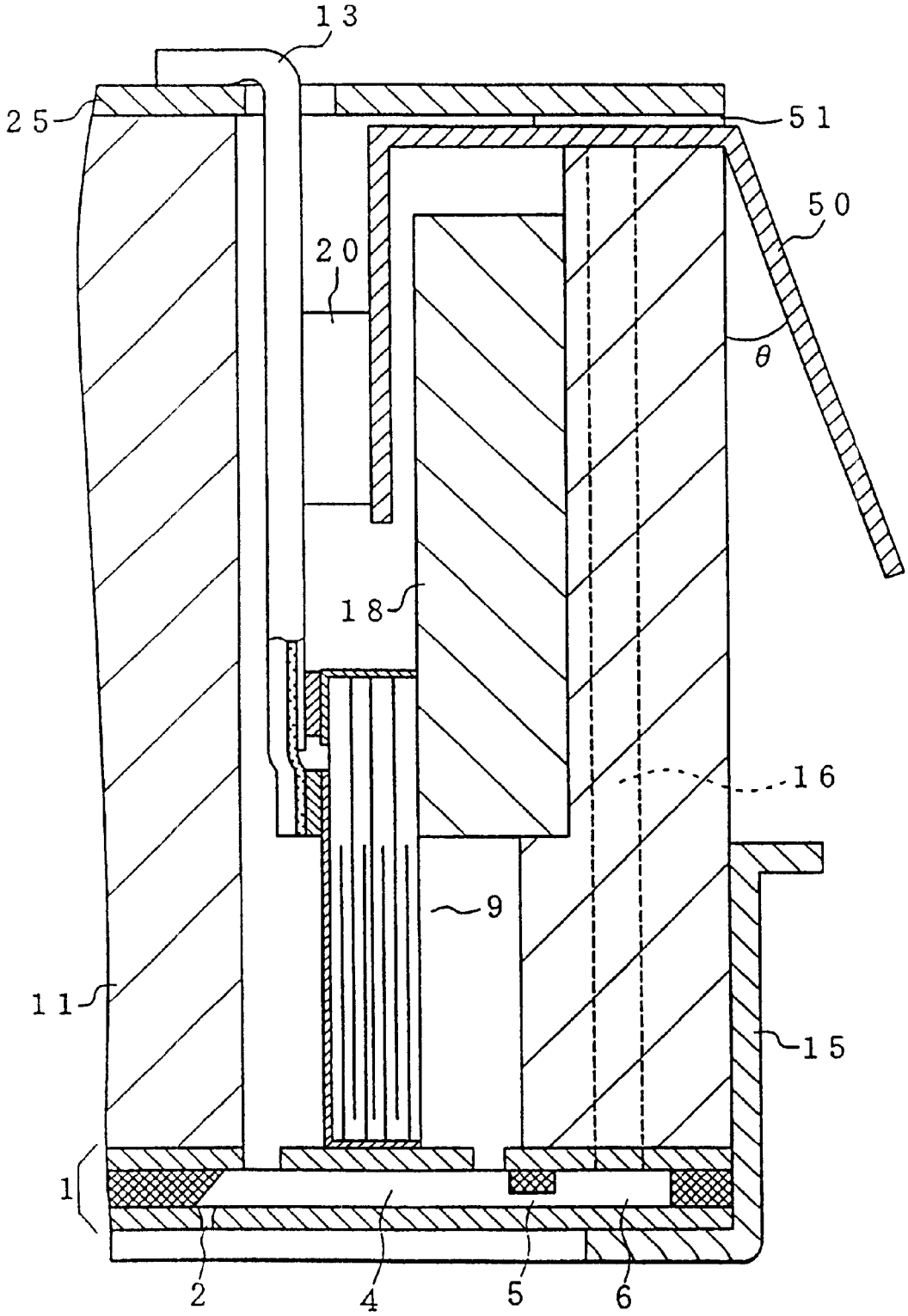
FIG. 19 is a sectional view showing another embodiment of the present invention.

In the above-mentioned embodiment, the heat conductive material 50 is attached to the side of the head case 11. On the other hand, when the heat conductive material 50 is bent at a predetermined angle $\theta$ against the head case 11 side, as shown in FIG. 19, the heat conductive material is exposed to air on both sides of the heat conductive material 50, so that the cooling effect is improved.

In this way, the heat of the heat conductive material 50 is desired to be cooled from other members, so that heat dissipation is increased by mounting an ink cartridge on an upper head case 11, or conducting, the heat in the heat conductive material 50 to the ink cartridge or a cartridge in case of a recording apparatus mounted on the ink cartridge via a carriage.

When the generated heat of the semiconductor integrated circuit for generating a drive signal, especially of an analog switch, such as a transfer gate switching a drive power "ON" or "OFF" to each piezoelectric vibrator, is increased and the drive power is supplied in a condition in which no ink is present, the temperature of the semiconductor integrated circuit increases rapidly and exceeds an allowable temperature within a few minutes.

In order to solve such a problem, a temperature sensor can be disposed in the vicinity of the semiconductor integrated circuit to control by a signal. However, providing the sensor complicates the manufacturing process and there is a problem that detecting through the case of the semiconductor integrated circuit causes a delayed responses and brings low reliance.

Figure 20A:
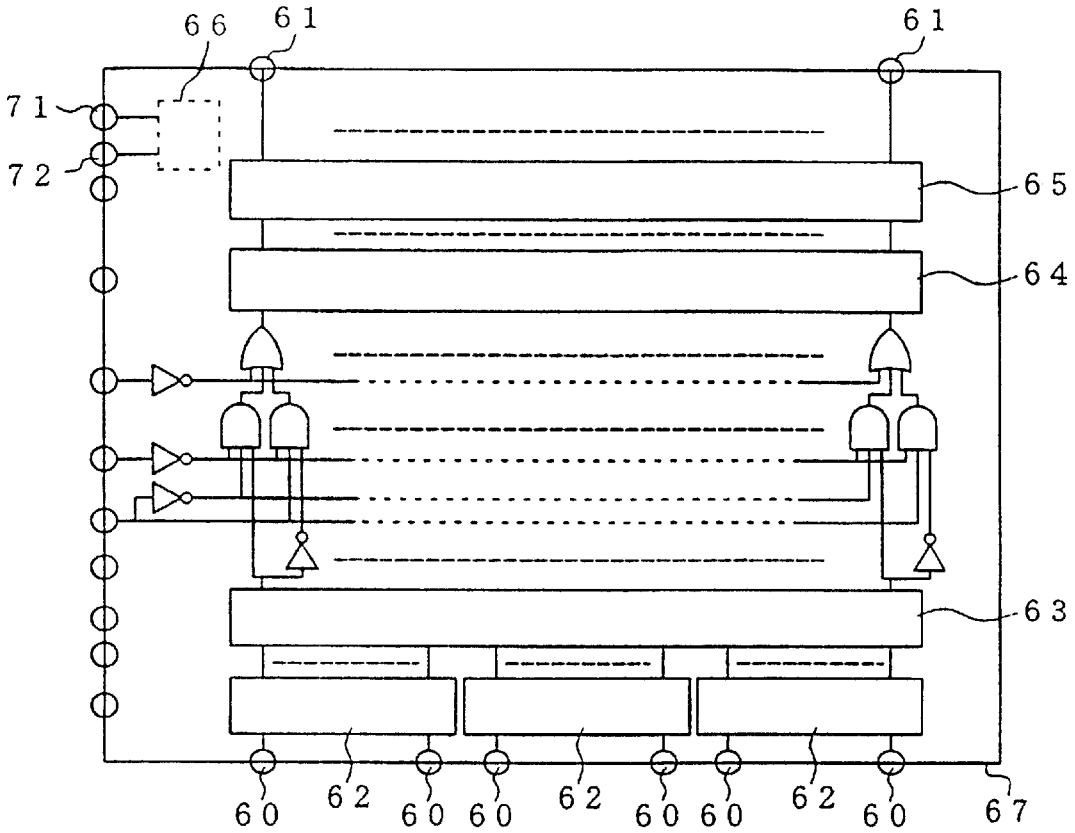
FIG. 20(*a*) is a block diagram showing one embodiment of a semiconductor integrated circuit used for an ink jet recording head, and FIG. 20(*b*) is an enlarged view showing the area which detects temperature, according to the present invention.
Figure 20B:
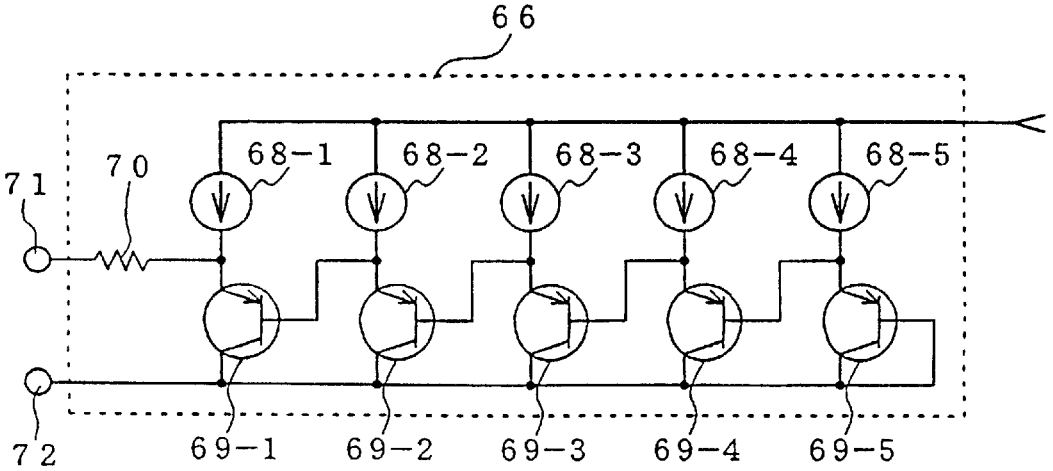
Figure 21:
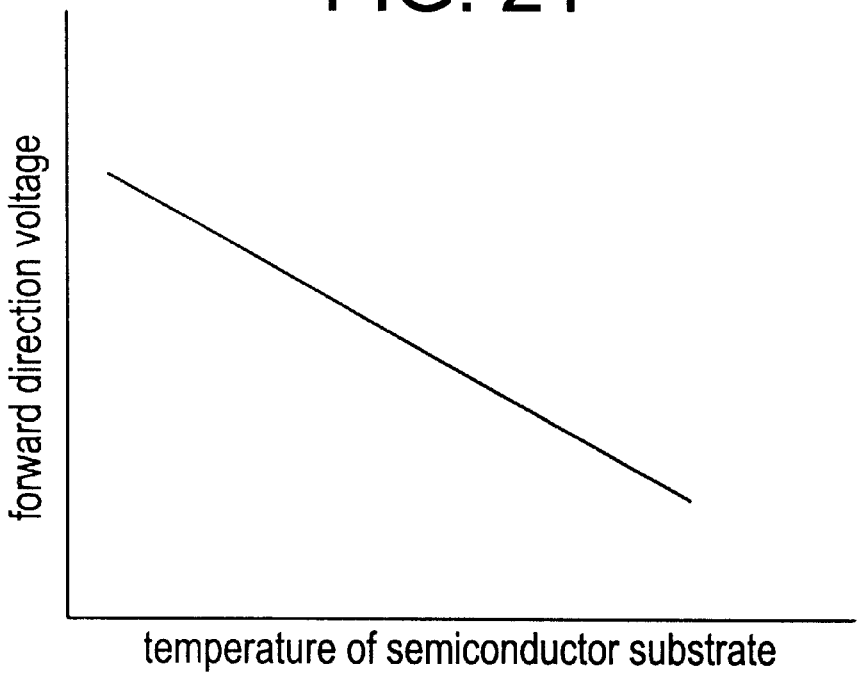
FIG. 21 is a chart showing the relationship between temperature and output voltage of temperature detecting diodes.

FIG. 20(*a*) shows one embodiment of the above-mentioned semiconductor integrated circuit 20 which solves such a problem. On a silicon semiconductor substrate 67 a diode forming area 66 for detecting temperature is formed to be as close as possible at one side of a shift resister 62, a latch circuit 63, a level shift circuit 64, and an analog switch 65 for outputting a drive signal to the piezoelectric vibrator 9 from a side of a print signal input terminal 60 to a side of a drive signal output terminal 61.

In the diode forming area for detecting temperature 66 as shown in FIG. 20(*b*), a plurality of transistors, or five transistors 69-1, 69-2, 69-3, 69-4, and 69-5 in this embodiment are formed to receive current from constant current sources 68-1, 68-2, 68-3, 68-4, and 68-5, respectively. A base of 69-1 is connected with an emitter of 69-2, a base of 69-2 is connected with an emitter of 69-3 . . . in series. The emitter of the transistor 69-1 is led to a terminal 71 via a resistance 70, and the base of the transistor 69-5 is connected with a collector of each transistor 69-1 . . . 69-5, which is connected with other circuit.

In such a construction, when constant current is supplied to the transistors 69-1, 69-2, 69-3, 69-4, and 69-5 from the constant current source 68-1, 68-2, 68-3, 68-4, and 68-5, forward direction voltage is generated in the proportion to the temperature of the semiconductor substrate 67 composing the semiconductor integrated circuit 20 as shown in FIG. 20(*b*).

Figure 22:
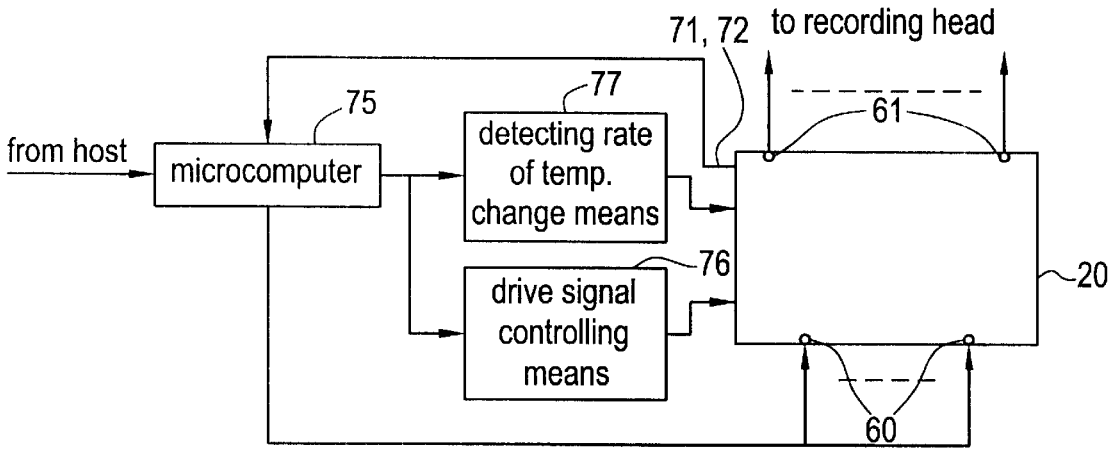
FIG. 22 is a block diagram showing one embodiment of a drive circuit of a recording head.
Figure 24:
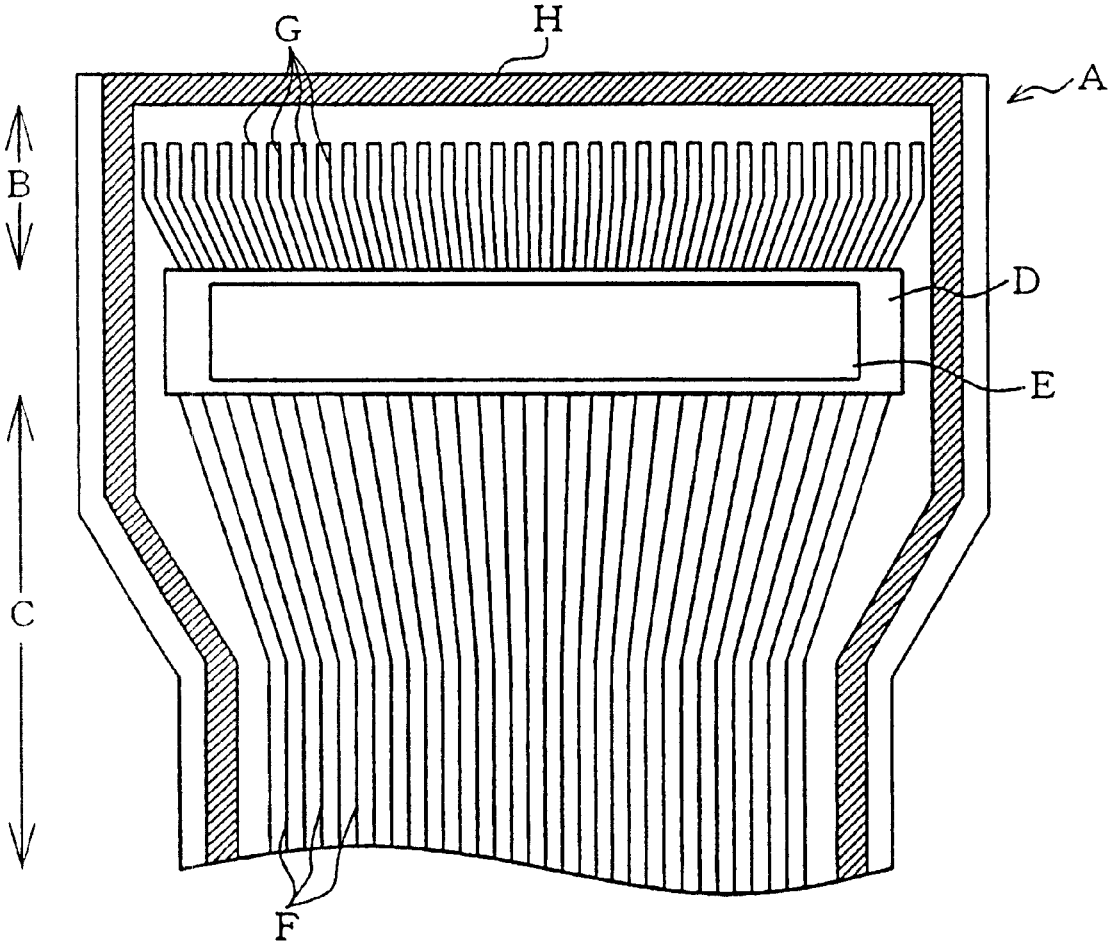
FIG. 24 shows an example of a flexible cable which connects a piezoelectric vibrator with an external drive circuit.

FIG. 22 shows an embodiment of a drive circuit controlling the above-mentioned recording head, a signal from the terminals 71 and 72 connecting the transistors for detecting temperature 69-1, 69-2, 69-3, 69-4, and 69-5 is converted to a digital signal by an analog-digital conversion means in a microcomputer 75 composing a control means, and input to a drive signal controlling means 76 and a detecting rate of temperature change means 77.

The drive signal controlling means 76 regards the detected temperature as environmental temperature, adjusts a level of the drive signal and ratio of piezo electric change, expands and contracts the piezoelectric vibrators 9, pressurizes the pressure generating chamber 4 in order to make ink pressure suitable for current temperature, and controls appropriate amount of ink.

Namely, the environmental temperature is divided with a plurality of basic levels T1, T2, T3, . . . Tn (for example, in case of n=3, $T1 \leqq 10°$ C., $10° C. < T2 < 30°$ C., $30° C. \leqq T3 \leqq 80°$ C.), and when the environmental temperature is less than T1, the drive signal is directly transmitted to the piezoelectric vibrator 9. When the environmental temperature is within T2, a level of the drive signal is decreased such as by 50%, and when the environmental temperature is within T3, the level is decreased such as by 80%. When the environmental temperature is beyond T3, the drive signal is stopped being supplied.

On the other hand, when a detecting rate of temperature change means 77 detects that the ratio of temperature change of the detected temperature is increased by predetermined value such as one degree per second, an off-order signal is output to a control terminal of the analog switch 65, and the analog switch 65 is compulsory turned off, and the drive signal is stopped from being supplied to the piezoelectric vibrators 9.

In this embodiment, when the semiconductor integrated circuit 20 receives a print signal from the external drive circuit via the flexible cable 13, the circuit controls the analog switch 65 connecting the piezoelectric vibrators 9 discharging ink, and supplies the drive signal to the piezoelectric vibrators 9. Then, the displaced piezoelectric vibrators 9 supply the ink in the reservoir 6 via an ink supply port 5 by expanding or contracting the pressure generating chamber 4 and discharge the ink droplet from the nozzle opening 2 by pressurizing the ink in the pressure generating chamber 4.

On the other hand, the temperature of the semiconductor integrated circuit 20 which is disposed in the vicinity of the piezoelectric vibrators 9 is changed in connection with the temperature of the pressure generating chamber 4 via the fixed base 18, so that the transistors for detecting temperature 69-1, 69-2, 69-3, 69-4, and 69-5 detect the environmental temperature.

Figure 23:
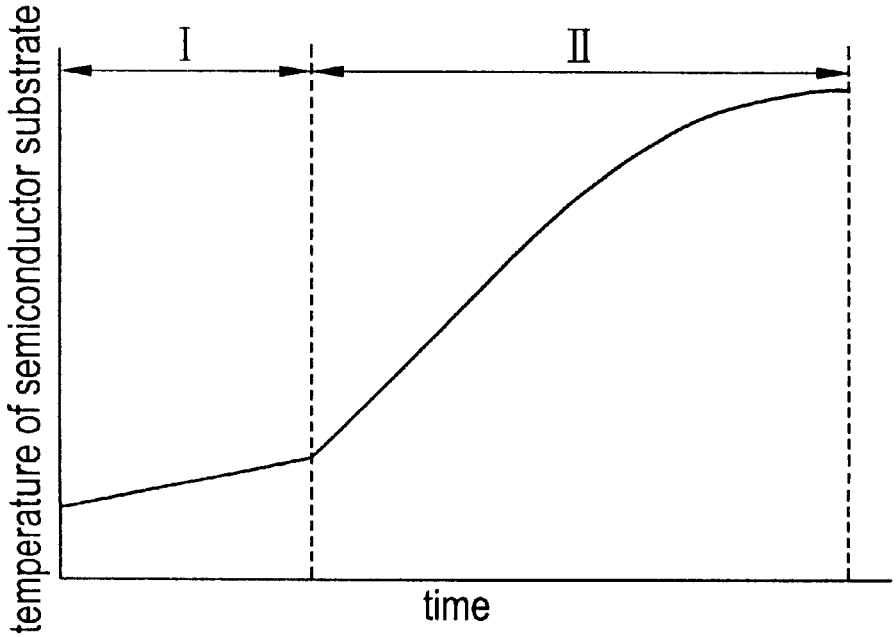
FIG. 23 is a chart showing the relationship between the temperature of the diodes during printing with ink and when the ink supply has been depleted.

In such condition of ejecting ink droplets, although temperature of the semiconductor substrate 67 is increased because of a loss generated in the analog switch 65 on a normal printing, the temperature balances the environmental temperature and keeps a steady state at a predetermined value as shown in the I area of the FIG. 23. Therefore, a parameter, such as the drive signal which affects a performance of the ink ejection, is controlled with reference to that temperature.

Accordingly, when the environmental temperature T is less than T1, the drive signal is directly transmitted to the piezoelectric vibrators 9, and ink whose viscosity is high is pressurized by high pressure, and a predetermined amount of the ink is discharged. When the environmental temperature is within T2, the level of the drive signal is decreased by 50%, and the ink amount is controlled by pressurizing the ink with weak pressure which corresponds to fall of the ink amount.

When the environmental temperature exceeds the basic level T3, radiating the piezoelectric vibrators is facilitated by interrupting supplying the drive signal. When the temperature is decreased by two ranks lower than the basic level T2, the drive signal is supplied again. Therefore, even if the temperature in the environment is extraordinary high, printing is continued without deteriorating the print quality.

When the drive signal is transmitted to the piezoelectric vibrator 9 in the condition that the ink of the ink cartridge is used up and no ink remains in the pressure generating chamber 4, load current of the piezoelectric vibrator 9 is increased, which causes large loss of the analog switch 65. In this case, the temperature of the semiconductor substrate 67 is rapidly increased as shown in area II of FIG. 23. The heat is conducted to the semiconductor substrate 67 forming the semiconductor integrated circuit 20, which changes the temperature of the transistors for detecting temperature 69-1, 69-2, 69-3, 69-4, and 69-5.

When the ratio of temperature change exceeds predetermined value, the detecting ratio of temperature change: means 77 outputs the off-order signal, turns off all analog switch 65 and prevents the switch from being broken before the heat reaches at outrageous temperature.

In the above-mentioned embodiment, the flexible cable 13 is provided with the semiconductor integrated circuit 20, which connects the circuit substrate 25 as a substrate for attaching the recording head with the piezoelectric vibrator 9. However, the same effect is obtained when the flexible cable 13, which connects the external drive circuit with a vibrator unit, is provided with the semiconductor integrated circuit stored in the head case.

In the above-mentioned embodiment, the piezoelectric vibrator is used as a pressurizing means in the recording head, as an example. However, the same effect is evidently obtained when the semiconductor integrated circuit for generating the drive signal is stored in the ink recording head, and a generating means installed in a pressure generating chamber is applied as a pressurizing means to radiate the heat of the semiconductor integrated circuit of an ink jet type recording head.

Therefore, the present invention provides a highly reliable recording head, in which generated heat in the semiconductor integrated circuit installed in the recording head is promptly cooled to the outside, and which prevents the semiconductor integrated circuit from being uncontrolled.

What is claimed is:

1. An ink jet recording head having a case comprising:

a flow path unit forming a plurality of pressure generating chambers communicating with respective nozzle openings that are adapted to eject ink from said ink jet recording head, pressure generating means for pressurizing said pressure generating chambers, a semiconductor integrated circuit for supplying a drive signal to said pressure generating means, and a member to which heat of said semiconductor integrated circuit is conducted, wherein said pressure generating means is mounted on said member.

2. An ink jet recording head according to claim 1, wherein said member includes a first member and a second member.

3. An ink jet recording head according to claim 1, wherein said member is exposed to outside said case.

4. An ink jet recording head according to claim 1, wherein a liquid layer is disposed between said member and said semiconductor integrated circuit.

5. An ink jet recording head according to claim 1, wherein a plurality of fins for cooling said semiconductor integrated circuit is formed on said member.

6. An ink jet recording head according to claim 1, wherein an ink guide path is provided for transporting ink in the vicinity of said semiconductor integrated circuit.

7. An ink jet recording head according to claim 6, wherein said member includes a flat expanded area formed opposite said ink guide path.

8. An ink jet recording head according to claim 7, wherein the fixed base includes fins and concave parts which contact the ink in said expanded area.

9. An ink jet recording head according to claim 1, further including a heat conductive material extending from the inside of said case to the outside of said case.

10. An ink jet recording head according to claim 9, wherein said heat conductive material is composed of a thin metal plate or a foil.

11. An ink jet recording head according to claim 9, wherein an electrical insulated layer having heat conductivity is formed on a surface between said heat conductive material and said semiconductor integrated circuit.

12. An ink jet recording head according to claim 9, wherein said heat conductive material contacts a mold layer insulating said semiconductor integrated circuit.

13. An ink jet recording head according to claim 9, wherein said heat conductive material closely contacts an external surface side of said case.

14. An ink jet recording head according to claim 9, wherein an ink guide path for supplying ink to said flow path unit is formed in said case, and said heat conductive material is in the vicinity of said ink guide path.

15. An ink jet recording head according to claim 9, wherein said flow path unit and said case are fixed within a metal frame, and a part of the exposed area of said heat conductive material contacts said metal frame.

16. An ink jet recording head according to claim 15, wherein a layer which is a heat conductor and an electrical insulator is formed at a contacting area between said heat conductive material and said metal frame.

17. An ink jet recording head according to claim 9, wherein a cooling fin is provided at an exposed area of said heat conductive material.

18. An ink jet recording head according to claim 17, wherein an electrical insulator layer having heat conductivity is formed at a contacting area between said heat conductive material and said cooling fin.

19. An ink jet recording head according to claim 9, wherein a ventilated space is provided between an exposed area of said heat conductive material and said case.

20. An ink jet recording head according to claim 9, wherein said heat conductive material closely contacts (1) a carriage holder on which said ink jet recording head is mounted, and on which ink cartridges are installed, or (2) an outside surface of an ink carriage that is mounted on said case.

21. An ink jet recording head according to claim 1, wherein said semiconductor integrated circuit is provided with diodes for detecting temperature.

22. An ink jet recording head according to claim 21, wherein said diodes transmit a signal in proportion to the temperature detected to a switching means for supplying the drive signal to said pressurizing means.

23. An ink jet recording head according to claim 1, wherein concave parts are provided on said member.

24. An ink jet recording head according to claim 1, further including a cooling plate fixed to said member.

25. An ink jet recording head according to claim 24, wherein said cooling plate includes fins provided at an exposed surface of said cooling plate.

26. An ink jet recording head according to claim 24, wherein said cooling plate includes projections provided at an exposed surface of said cooling plate.

27. An ink jet recording head according to claim 1, further including a fin exposed to the outside for absorbing heat from said member.

28. An ink jet recording head according to claim 1, further including a drive signal controller which controls the drive signal as a function of a temperature detected by temperature detecting diodes.

29. An ink jet recording head according to claim 28, wherein said drive signal controller transmits the drive signal directly to said pressurizing means when said temperature is in a first range, reduces said drive signal by a first predetermined amount when said temperature is in a second range, and reduces said drive signal by a second predetermined amount when said temperature is in a third range.

30. An ink jet recording head comprising:

a flow path unit forming pressure generating chambers each of which communicate with respective nozzle openings, pressurizing means for pressurizing said pressure generating chambers, a fixed base fixed to said pressurizing means, a semiconductor integrated circuit supplying a drive signal to said pressurizing means;

wherein a length mode of said pressurizing means is fixed at a predetermined interval on said fixed base, and heat of said semiconductor integrated circuit is conducted to said fixed base.

31. An ink jet recording head according to claim 30, wherein heat conductive fluid is sandwiched between said semiconductor integrated circuit and said fixed base.

32. An ink jet recording head according to claim 30, wherein concave parts for cooling are formed on said fixed base.

33. An ink jet recording head according to claim 30, wherein fins for cooling are formed on said fixed base.

34. An ink jet recording head according to claim 30, wherein an exposed portion of said fixed base is exposed to an outside of a case of said ink jet recording head.

35. An ink jet recording head according to claim 34, wherein concave parts are formed on said exposed part.

36. An ink jet recording head according to claim 34 wherein fins are formed at said exposed part.

37. An ink jet recording head according to claim 30, wherein said fixed base is composed with metal or ceramics.

38. An ink jet recording head according to claim 30, wherein a circuit substrate is fixed at an opposite side of said flow path unit of a case of said ink jet recording head, and the heat of said fixed base is conducted to said circuit substrate.

39. An ink jet recording head according to claim 38, wherein a cooling support member is provided with said circuit substrate.

40. An ink jet recording head according to claim 39, wherein said cooling support member is provided with fins.

41. An ink jet recording head according to claim 39, wherein said cooling support member is made of metal.

42. An ink jet recording head according to claim 38, wherein an ink guide path is formed at an area where heat is conducted to said case.

43. An ink jet recording head according to claim 42, wherein an area of said ink guide path to which heat is conducted is expanded.

44. An ink jet head according to claim 43, wherein a wall thickness of a portion of said ink guide path that contacts said fixed base is thin.

45. An ink jet recording head according to claim 42, wherein said fixed base is provided with a flow path in which ink of said ink guide path flows.

46. An ink jet recording head according to claim 42, wherein a portion of said ink guide path is expanded and includes an opening that is sealed by said fixed base.

47. An ink jet recording head according to claim 46, wherein concave parts are formed in a face of that said fixed base that seals said opening of said ink guide path.

48. An ink jet recording head according to claim 47, wherein fins are formed in said concave parts.

49. An ink jet heat according to claim 42, wherein said ink guide path includes an expanded section formed at a location where said ink guide path contacts said fixed base.

50. An ink jet recording head according to claim 30, further including an ink guide path extending through said recording head, said ink guide path including a concave part and communicating holes communicated with an ink guide inlet of said flow path unit, and a flow path forming member including an elastic member which seals said concave part and contacts said fixed base.

51. An ink jet recording head according to claim 50, wherein said concave part is formed at a backside facing said fixed base to form a gap between said flow path forming member and said concave part, whereby pressure fluctuation of the ink flowing in said flow path forming member is absorbed by elastic deformation of said flow path forming member.

52. An ink jet recording head according to claim 30, wherein said fixed base is composed of a first area forming member to which said pressurizing means is fixed, and a second area forming member having higher heat conductivity than that of the first area forming member, and said second area forming member is fixed to said semiconductor integrated circuit.

53. An ink jet recording head according to claim 52, further including a concave part formed on at least said second area, wherein said concave part contacts ink in an ink guide path.

54. An ink jet recording head according to claim 52, wherein a circuit base is fixed to an opposite surface of fixed said flow path unit in said case, and the heat of said semiconductor integrated circuit is conducted to one edge of the second area forming member of said fixed substrate and said circuit substrate.

55. An ink jet recording head according to claim 30, wherein a part of a cable supplying the drive signal to said pressurizing means is bonded to said fixed base by an adhesive.

56. An ink jet recording head according to claim 30, wherein temperature detecting diodes are provided with a semiconductor substrate forming said semiconductor integrated circuit, and said temperature detecting diodes detect a temperature change of said semiconductor substrate.

57. An ink jet recording head according to claim 56, wherein said temperature detecting diodes are formed in the vicinity of a switching means for supplying the drive signal to said pressurizing means.

58. An ink jet recording head having a case comprising:

a flow path unit forming a plurality of pressure generating chambers communicating with respective nozzle openings that are adapted to eject ink from said ink jet recording head, pressure generating means for pressurizing said pressure generating chambers, a semiconductor integrated circuit for supplying a drive signal to said pressure generating means, and a heat conductive material extending from the inside of said case to the outside of said case, wherein heat of said semiconductor integrated circuit is conducted to said heat conductive material, and wherein said heat conductive material extends to an end of a backside of said case, the backside being opposite a side of said case that is connected to said flow path unit.

59. An ink jet recording head according to claim 58, wherein said heat conductive material is composed of a thin metal plate or a foil.

60. An ink jet recording head according to claim 58, wherein an electrical insulated layer having heat conductivity is formed on a surface between said heat conductive material and said semiconductor integrated circuit.

61. An ink jet recording head according to claim 58, wherein said heat conductive material contacts a mold layer insulating said semiconductor integrated circuit.

62. An ink jet recording head according to claim 58, wherein said heat conductive material closely contacts an external surface side of said case.

63. An ink jet recording head according to claim 58, wherein an ink guide path for supplying ink to said flow path unit is formed in said case, and said heat conductive material is in the vicinity of said ink guide path.

64. An ink jet recording head according to claim 58, wherein said flow path unit and said case are fixed within a metal frame, and a part of the exposed area of said heat conductive material contacts said metal frame.

65. An ink jet recording head according to claim 64, wherein a layer which is a heat conductor and an electrical insulator is formed at a contacting area between said heat conductive material and said metal frame.

66. An ink jet recording head according to claim 58, wherein a cooling fin is provided at an exposed area of said heat conductive material.

67. An ink jet recording head according to claim 66, wherein an electrical insulator layer having heat conductivity is formed at a contacting area between said heat conductive material and said cooling fin.

68. An ink jet recording head according to claim 58, wherein a ventilated space is provided between an exposed area of said heat conductive material and said case.

69. An ink jet recording head according to claim 58, wherein said heat conductive material closely contacts (1) a carriage holder on which said ink jet recording head is mounted, and on which ink cartridges are installed, or (2) an outside surface of an ink carriage that is mounted on said case.

* * * * *